US008318400B2

(12) United States Patent
Watanabe et al.

(10) Patent No.: US 8,318,400 B2
(45) Date of Patent: Nov. 27, 2012

(54) METHOD OF PREPARING TONER AND THE TONER, AND DEVELOPER AND IMAGE FORMING METHOD USING THE TONER

(75) Inventors: Yohichiroh Watanabe, Fuji (JP); Kazumi Suzuki, Shizuoka-ken (JP); Takahiro Honda, Fujinomiya (JP); Shinji Ohtani, Shizuoka-ken (JP); Yoshihiro Norikane, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 987 days.

(21) Appl. No.: 12/264,299

(22) Filed: Nov. 4, 2008

(65) Prior Publication Data

US 2009/0117486 A1 May 7, 2009

(30) Foreign Application Priority Data

Nov. 6, 2007 (JP) ..... 2007-288724

(51) Int. Cl.
*G03G 9/087* (2006.01)

(52) U.S. Cl. ..... 430/137.1; 430/111.4

(58) Field of Classification Search ..... 430/137.1, 430/111.4

See application file for complete search history.

(56) References Cited

U.S. PATENT DOCUMENTS

| | | | | |
|---|---|---|---|---|
| 5,153,301 | A * | 10/1992 | Tajiri et al. | 528/272 |
| 6,007,958 | A * | 12/1999 | Ito et al. | 430/109.4 |
| 7,709,175 | B2 * | 5/2010 | Ohtani | 430/137.1 |
| 8,012,663 | B2 * | 9/2011 | Norikane et al. | 430/137.19 |
| 8,034,526 | B2 * | 10/2011 | Watanabe et al. | 430/137.1 |
| 2006/0210909 | A1 * | 9/2006 | Ohtani | 430/137.1 |
| 2008/0063971 | A1 * | 3/2008 | Watanabe et al. | 430/110.4 |

FOREIGN PATENT DOCUMENTS

| | | |
|---|---|---|
| JP | 7-152202 | 6/1995 |
| JP | 2003-262976 | 9/2003 |
| JP | 2003-262977 | 9/2003 |
| JP | 2003-280236 | 10/2003 |
| JP | 2006-28432 | 2/2006 |
| JP | 2006-72156 | 3/2006 |
| JP | 2006-72158 | 3/2006 |
| JP | 2006-293320 | 10/2006 |
| JP | 2007-199463 | 8/2007 |

OTHER PUBLICATIONS

Japanese Office Action issued Sep. 5, 2011, in Patent Application No. 2007-288724.

* cited by examiner

*Primary Examiner* — Janis L Dote
(74) *Attorney, Agent, or Firm* — Oblon, Spivak, McClelland, Maier & Neustadt, L.L.P.

(57) ABSTRACT

A method of preparing a toner, including periodically discharging a toner constituent liquid from plural nozzles having the same aperture diameter with a mechanical oscillator, wherein the toner constituent liquid includes:

a binder resin,
a colorant, and
an organic solvent, wherein the binder resin and the colorant are dissolved or dispersed in the organic solvent; forming a droplet of the toner constituent liquid in a gas phase; and solidifying the droplet, wherein the aperture diameter is from 3 to 30 μm, and the binder resin has a ratio (Mw/Mn) of a weight-average molecular weight (Mw) to a number-average molecular weight (Mn) of THF (tetrahydrofuran)-soluble components therein of from 1.5 to 15 in a molecular weight distribution measured by GPC (gel permeation chromatography), and a ½ flow temperature (Tm) of from 114 to 149° C.

6 Claims, 16 Drawing Sheets

METHOD OF PREPARING TONER AND THE TONER, AND DEVELOPER AND IMAGE FORMING METHOD USING THE TONER

BACKGROUND OF THE INVENTION

1. Field of the Invention

The present invention relates to a method of preparing toner and the toner, and a developer and an image forming method using the toner.

2. Discussion of the Background

Developers for use in electrophotography, electrostatic recording and electrostatic printing, in their development processes, are transferred to image bearers such as photoreceptors electrostatic latent images are formed on, transferred therefrom to a transfer medium such as a transfer paper, and fixed thereon. As the developers for developing electrostatic latent images formed on image bearers, a two-component developer including a carrier and a toner, and a one-component developer without a carrier, such as a magnetic toner and a nonmagnetic toner, are known.

Conventionally, as a dry toner for use in electrophotography, electrostatic recording and electrostatic printing, a pulverized toner is widely used, which is formed by kneading a toner binder such as styrene resins and polyester resins with a colorant, etc. upon application of heat, cooling the kneaded mixture to be solidified and pulverizing the solidified mixture.

Recently, polymerized toners prepared by suspension polymerization methods, emulsion polymerization condensation methods, etc. are being used. Besides, Japanese published unexamined application No. 7-152202 discloses a polymer solution suspension method of using a volume contraction. This method includes dispersing or dissolving toner constituent in a volatile solvent such as an organic solvent having a low boiling point to prepare a dispersion or a solution, emulsifying the dispersion or solution in an aqueous medium to form a droplet, and removing the volatile solvent. The diversity of resins this method can use is wider than those of the suspension polymerization methods and emulsion polymerization condensation methods, and has an advantage of being capable of using a polyester resin effectively used for full-color images requiring transparency and smoothness after fixed.

However, in the polymerization methods, since a dispersant is basically used in an aqueous medium, the dispersant impairing the chargeability of a toner remains on the surface thereof, resulting in deterioration of environmental resistance. In addition, a large amount of water is needed to remove the dispersant, resulting in unsatisfactory methods of preparing a toner.

Japanese published unexamined application No. 2003-262976 discloses a method and an apparatus forming a microscopic droplet of a toner constituent with a piezoelectric pulse, and drying and solidifying the microscopic droplet to form a toner. Further, Japanese published unexamined application No. 2003-280236 discloses a method of forming a microscopic droplet thereof with a heat expansion in a nozzle, and drying and solidifying the microscopic droplet to form a toner. Furthermore, Japanese published unexamined application No. 2003-262977 discloses a method of forming a microscopic droplet with an acoustic lens, and drying and solidifying the microscopic droplet to form a toner. However, these methods discharge a droplet only from one nozzle, and the number of the droplets dischargeable per unit of time is small, resulting in poor productivity. At the same time, the droplets are inevitably combined each other, resulting in a wide particle diameter distribution and low mono-dispersibility.

Japanese published unexamined applications Nos. 2006-28432 and 2006-28433 disclose a method of intermittently discharging a dispersion in which toner materials including a thermosetting resin or a UV curable resin are finely dispersed in a dispersion medium to form a droplet, agglutinating the droplet and hardening the thermosetting resin or the UV curable resin to stabilize formation of a particle. However, these methods have low productivity and insufficient mono-dispersibility as the above-mentioned Japanese published unexamined applications Nos. 7-152202, 2003-262976, 2003-280236 and 2003-262977. Although the resins are hardened after a particle is formed, the properties after fixed are not satisfactory.

The methods disclosed in Japanese published unexamined applications Nos. 2006-28432 and 2006-28433 directly contact the oscillator to a fluid. In such a constitution, the resultant toner has a sharp particle diameter distribution when the numbers of the orifices and oscillators are same. However, when the constitution has one oscillator and many orifices, the sizes of droplets vary depending on distances between the orifices and the oscillator, resulting in production of toners having different particle diameters among plural orifices.

These dry toners are typically contacted, heated, melted and fixed on a paper, etc. with a heated roll or belt after developed and transferred onto the paper because of its high heat efficiency. When the heated roll or belt has too high a temperature, the toner is melted so excessively that the toner is bonded with the heated roll or belt, i.e., a hot offset problem. When the heated roll or belt has too low a temperature, the toner is not fully melted and fixed on the paper. In terms of saving energy and downsizing the apparatus, a toner having a higher hot offset generation temperature (good hot offset resistance) and a low fixable temperature (good low-temperature fixability) is desired. In addition, a toner needs thermostable preservability as well to avoid blocking at environmental temperatures in a container and an apparatus. Above all, since full-color images need glossiness and mixability, the toner needs a lower melting viscosity and a toner binder having sharp meltablity is used therein.

However, such a toner is likely to have a hot offset problem, and silicone oils are conventionally applied to heat rolls in full-color image forming apparatuses. However, the full-color image forming apparatuses need oil tanks and oil applicators to apply oils to the heat rolls and become complicated and large. The oils inevitably adhere to copy papers and OHP films, resulting in deterioration of writability of an aqueous ink and color toner on the OHP film.

In order to prevent the hot offset without applying an oil to the heat roll, a release agent such as a wax is added to the toner, or a polymeric or crosslinking material is introduced to a binder resin to increase the viscoelasticity when melted.

However, a toner constituent liquid including a binder resin the polymeric or crosslinking material is introduced to is very difficult to discharge from a nozzle having microscopic orifices with a mechanical oscillator.

Particularly, recent toners tend to have small particle diameters to produce high-definition and high-quality images, and it is more difficult to produce toners having both offset resistance and dischargeability from a nozzle.

Because of these reasons, a need exists for a method of efficiently preparing a toner having good offset resistance, better mono-dispersibility than ever before and no or scarce variation of image quality with a toner constituent liquid having good dischargeability from a nozzle.

SUMMARY OF THE INVENTION

Accordingly, an object of the present invention is to provide a method of efficiently preparing a toner having good offset resistance, better mono-dispersibility than ever before and no or scarce variation of image quality with a toner constituent liquid having good dischargeability from a nozzle.

Another object of the present invention is to provide a toner prepared by the method.

A further object of the present invention is to provide a developer using the toner.

Another object of the present invention is to provide an image forming method using the toner.

These objects and other objects of the present invention, either individually or collectively, have been satisfied by the discovery of a method of preparing a toner, comprising:

periodically discharging a toner constituent liquid from plural nozzles having the same aperture diameter with a mechanical oscillator, wherein the toner constituent liquid comprises:

a binder resin, a colorant, and an organic solvent, wherein the binder resin and the colorant are dissolved or dispersed in the organic solvent;

forming a droplet of the toner constituent liquid in a gas phase; and solidifying the droplet, wherein the aperture diameter is from 3 to 30 μm, and the binder resin has a ratio (Mw/Mn) of a weight-average molecular weight (Mw) to a number-average molecular weight (Mn) of THF (tetrahydrofuran)-soluble components therein of from 1.5 to 15 in a molecular weight distribution measured by GPC (gel permeation chromatography), and a ½ flow temperature of from 114 to 149° C.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides a method of efficiently preparing a toner having good offset resistance, better mono-dispersibility than ever before and no or scarce variation of image quality with a toner constituent liquid having good dischargeability from a nozzle.

More particularly, the present invention relates to a method of preparing a toner, comprising:

periodically discharging a toner constituent liquid from plural nozzles having the same aperture diameter with a mechanical oscillator, wherein the toner constituent liquid comprises:

a binder resin, a colorant, and an organic solvent, wherein the binder resin and the colorant are dissolved or dispersed in the organic solvent;

forming a droplet of the toner constituent liquid in a gas phase; and solidifying the droplet, wherein the aperture diameter is from 3 to 30 μm, and the binder resin has a ratio (Mw/Mn) of a weight-average molecular weight (Mw) to a number-average molecular weight (Mn) of THF(tetrahydrofuran)-soluble components therein of from 1.5 to 15 in a molecular weight distribution measured by GPC (gel permeation chromatography), and a ½ flow temperature of from 114 to 149° C. Preferably, the binder resin is completely dissolved in the organic solvent.

As means of forming a droplet of a toner constituent liquid in a gas phase, one fluid nozzle (pressure nozzle) pressurizing a liquid to be sprayed therefrom, a multiple fluid nozzle mixing a liquid and compressed air to spray the liquid, and a rotating disc sprayer rotating a disc to form a droplet of the liquid with a centrifugal force are conventionally known. These means are difficult to prepare a toner having a small particle diameter, and prepare a toner having a wide particle diameter distribution. Therefore, the toner needs classifying and yield loss increases, resulting in deterioration of productivity.

The present inventors realized a method of periodically forming a droplet periodically discharging a toner constituent liquid with a mechanical oscillator from a thin film having plural nozzles having a uniform diameter to prepare a toner having a uniform particle diameter.

The mechanical oscillator may have any formation as long as it oscillates in a direction perpendicular to the film having nozzles. In the present invention, the following two mechanical oscillators are preferably used.

One is a mechanical longitudinal-direction oscillator having an oscillation surface parallel to a thin film having plural nozzles and oscillating in a longitudinal direction perpendicular thereto, and the other is a circular mechanical oscillator circularly formed on the circumference of an area of a thin film, where plural nozzles are formed.

Hereinafter, each of the two methods will be explained.

Figure 1:
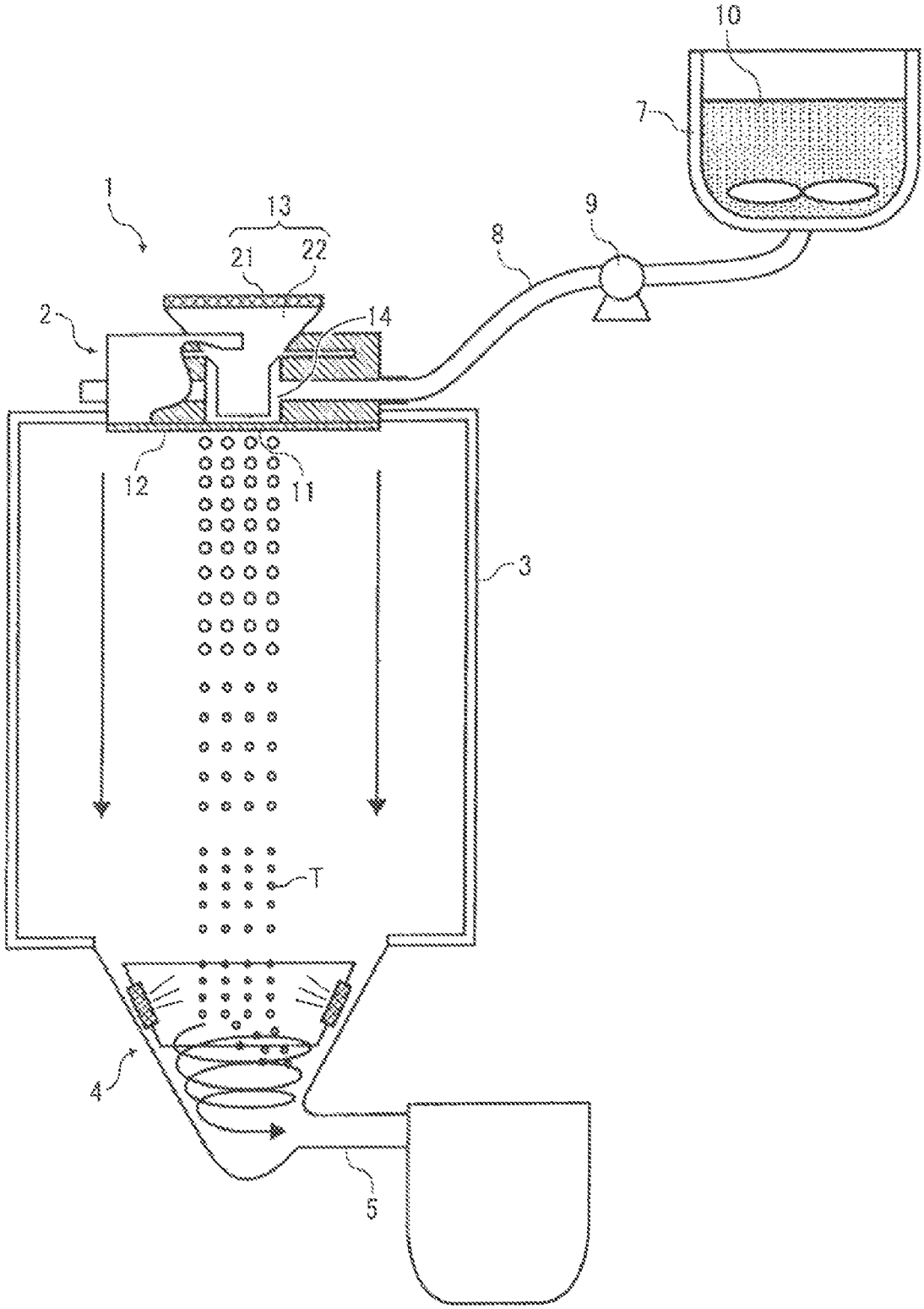
FIG. 1 is a schematic view illustrating an embodiment of the toner preparation apparatus of the present invention.

First, an embodiment of a toner preparation apparatus using the mechanical longitudinal-direction oscillator will be explained, referring to FIG. 1.

An apparatus 1 includes a droplet spray unit 2 as a droplet former periodically discharging a toner constituent liquid including at least a resin and a colorant from plural nozzles having the same aperture diameter and forming a droplet thereof in a gas phase; a granulator 3 solidifying the droplet from the droplet spray unit 2 located above to form toner particles T; a toner collector 4 collecting the toner particles T; a toner storage storing the toner particles T transferred through a tube 5 from the toner collector 4; a material container 7 containing the toner constituent liquid 10; a liquid feeding pipe 8 feeding the toner constituent liquid 10 from the material container 7 to the droplet spray unit 2; and a pump 9 pumping the toner constituent liquid 10 through the liquid feeding pipe 8.

The toner constituent liquid 10 from the material container 7 is automatically fed to the droplet spray unit 2. The pump 9 subsidiarily assists feeding the liquid. The toner constituent liquid 10 is a toner constituent solution or a dispersion including a solvent, and at least a resin and a colorant dissolved or dispersed therein.

Figure 2:
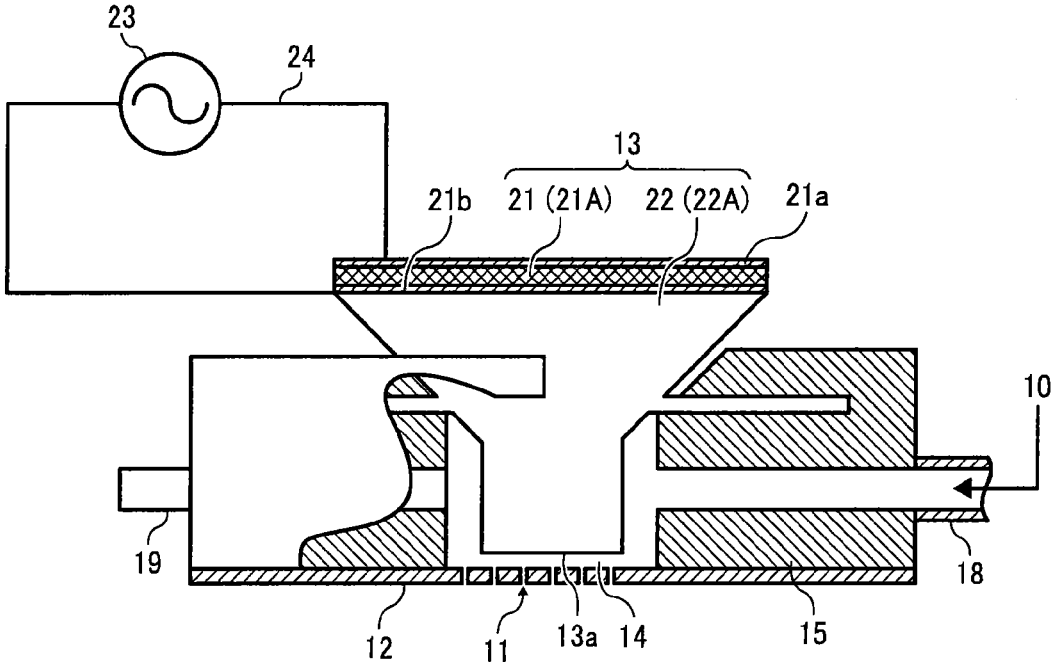
FIG. 2 is an enlarged view of an embodiment of a droplet spray unit of the toner preparation apparatus in FIG. 1.
Figure 3:
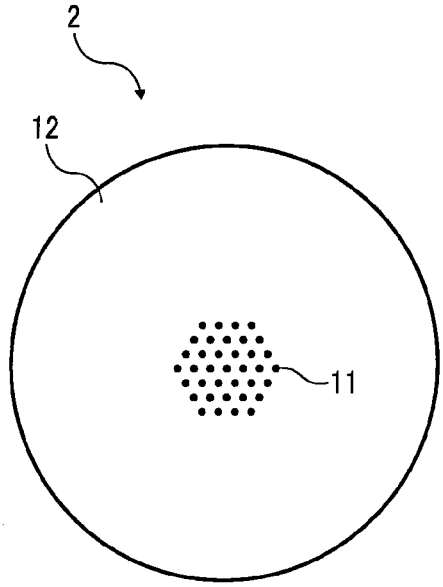
FIG. 3 is a bottom view of the droplet spray unit in FIG. 2.

Next, the droplet spray unit 2 will be explained, referring to FIGS. 2 and 3. FIG. 2 is an enlarged view of an embodiment of a droplet spray unit of the toner preparation apparatus in FIG. 1, and FIG. 3 is a bottom view of the droplet spray unit in FIG. 2.

The droplet spray unit 2 includes a thin film 12 having plural nozzles (discharge holes; a mechanical oscillator (hereinafter referred to as an oscillator) 13 oscillating the thin film 12; and a flow path member 15 forming a reservoir (liquid flowpath) 14 retaining the toner constituent liquid 10 including at least a resin and a colorant between the thin film 12 and the oscillator 13.

The thin film 12 having plural nozzles 11 is located parallel to an oscillation surface 13*a* of the oscillator 13. A part of the thin film 12 is fixed on the flow path member 15 with a solder or a binder resin insoluble in the toner constituent liquid, and is substantially located perpendicular to the oscillation direction of the oscillator 13. A communicator 24 is arranged to apply an electrical signal to an upper surface and a bottom surface of an oscillation generator 21 o the oscillator 13, and converts a signal from a drive signal generator 23 into a mechanical oscillation. A lead wire, the surface of which is insulatively coated is preferably used as the communicator 24 applying an electrical signal. Various horn oscillators and bolted Langevin type oscillators having large amplitudes mentioned later are preferably used as the oscillator 13 to efficiently and stably prepare a toner.

The oscillator 13 includes an oscillation generator 21 and an oscillation amplifier 22 amplifying an oscillation generated by the oscillation generator 21. A drive circuit (derive signal generator) 23 applies a drive voltage (drive signal) having a required frequency between electrodes 21*a* and 21*b* of the oscillation generator 21 to excite an oscillation thereof. The oscillation is amplified by the oscillation amplifier 22 and an oscillation surface 13*a* periodically oscillates to oscillate the thin film 12 at a required frequency.

The oscillator 13 is not particularly limited, provided it can vertically oscillate the thin film 12 at a constant frequency. The oscillation generator 21 preferably includes a bimorph piezoelectric body 21A exciting a flexural oscillation for oscillating the thin film 12. The piezoelectric body 21A converts an electrical energy to a mechanical energy. Specifically, when a voltage is applied to the piezoelectric body 21A, a flexural oscillation is excited to oscillate the thin film 12.

Specific examples of the piezoelectric body 21A forming the oscillation generator 21 include piezoelectric ceramics such as lead zirconate titanate (LZT). The piezoelectric ceramics are typically layered because of having a small displacement. Besides, piezoelectric polymers such as polyvinylidenefluoride (PVDF) and single crystals such as quartz, $LiNbO_3$, $LiTaO_3$ and $KNbO_3$ are preferably used.

The oscillator 13 is located anywhere, provided it can vertically oscillate the thin film 12 having the nozzle 11. The oscillation surface 13*a* and the thin film 12 are parallely located each other.

A horn oscillator can be used as the oscillator 13 formed of the oscillation generator 21 and the oscillation amplifier 22. Since the horn oscillator amplifies an oscillation of the oscillation generator 21 such as a piezo element with a horn 22A as the oscillation amplifier 22, a mechanical load thereon is not so large that the horn oscillator has a long life.

Figure 4:
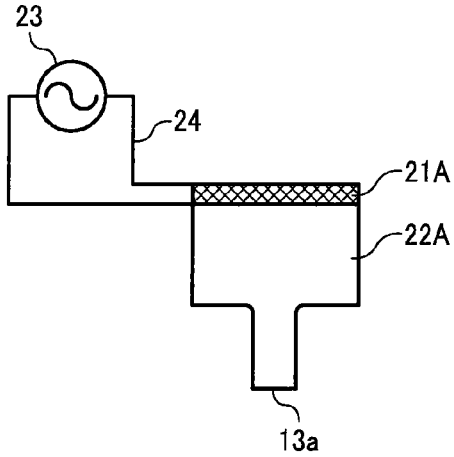
FIG. 4 is a schematic view illustrating a step-shaped horn oscillator forming an embodiment of the oscillation generator of the droplet spray unit in FIG. 2.
Figure 5:
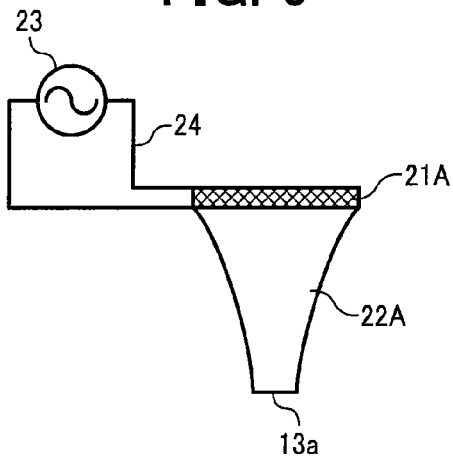
FIG. 5 is a schematic view illustrating an exponential horn oscillator forming another embodiment of the oscillation generator of the droplet spray unit in FIG. 2.
Figure 6:
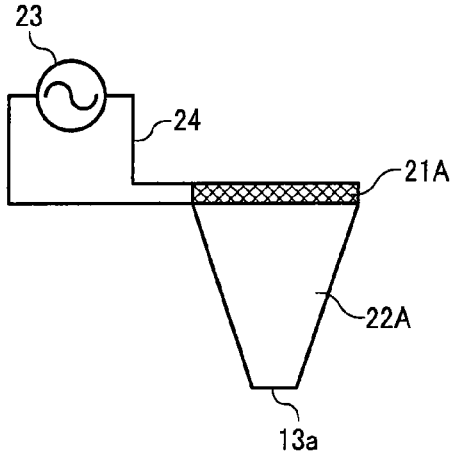
FIG. 6 is a schematic view illustrating a conical horn oscillator forming a further embodiment of the oscillation generator of the droplet spray unit in FIG. 2.

The horn oscillator may have any known shapes of horns such as a step type in FIG. 4, an exponential type in FIG. 5 and a conical type on FIG. 6. The piezoelectric body 21A is located on the surface having a larger area of the horn 22A. The piezoelectric body 21A induces an efficient oscillation of the horn 22A with longitudinal oscillation, and the horn 22A is designed to have the maximum oscillation surface 13*a* having a smaller area. A lead wire 24 is located above and below the piezoelectric bodies 21A and an AC voltage signal is applied thereto from a drive circuit 23. The shape of the horn oscillator is designed such that the horn oscillator has the maximum oscillation surface 13*a*.

In addition, a particularly high-strength bolted Langevin type oscillator can also be used as the oscillator 13. A mechanically combined piezoelectric ceramics forms the bolted Langevin type oscillator, and which does not break when oscillating at a high amplitude.

The reservoir, mechanical oscillator and thin film will be explained in detail, referring to FIG. 2. At least a liquid feeding tube 18 is connected to the reservoir 14 to feed the toner constituent liquid thereto through liquid flow path. In addition, an air bubble discharge tube 19 can be connected thereto when desired. A holder (not shown) installed on the flow path member 15 holds the droplet spray unit 2 on the ceiling of the granulator 3. The droplet spray unit 2 may be located on the drying side surface or the bottom of the granulator 3.

The oscillator 13 typically becomes larger as the frequency reduces, and may optionally be directly subjected to hole drilling to have a reservoir according to a required frequency. Further, the whole reservoir can efficiently be oscillated. In this case, the oscillation surface is defined as a surface laminated with the thin film having plural nozzles.

Different embodiments of the droplet spray unit 2 will be explained, referring to FIGS. 7 and 8.

Figure 7:
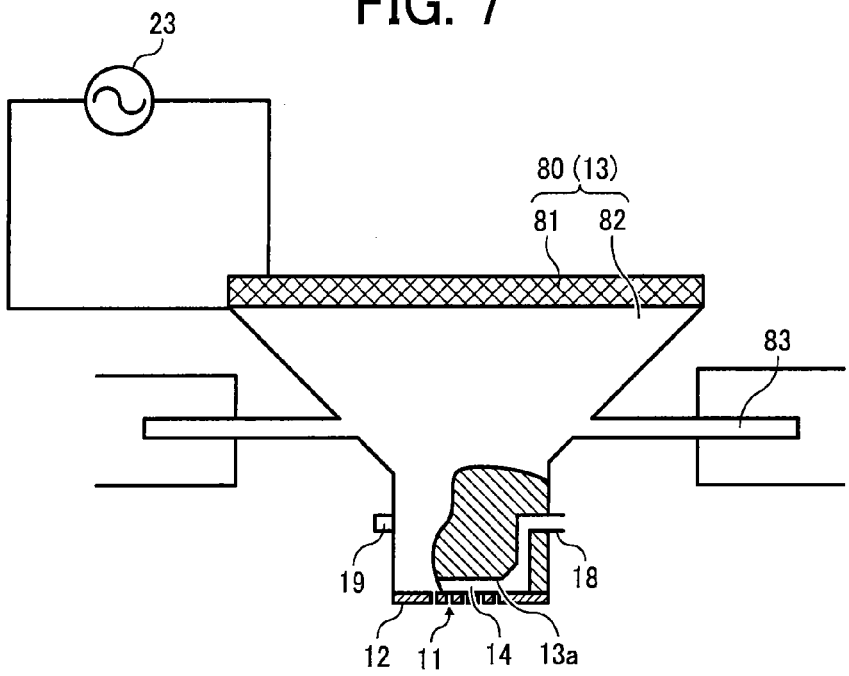
FIG. 7 is an enlarged view of another embodiment of the droplet spray unit of the toner preparation apparatus in FIG. 1.

In FIG. 7, a horn type oscillator 80 formed of a piezoelectric body 81 as an oscillation generator and a horn 82, in which a reservoir (flow path) 14 is partially formed, as an amplifier is used as the oscillator 13. The droplet spray unit 2 is preferably fixed on the drying side surface of the granulator 3 by a flange 83 integrally-formed with the horn 82 of the horn type oscillator 80. In terms of preventing oscillation loss, an elastic body (not shown) can be used to fix the droplet spray unit 2.

Figure 8:
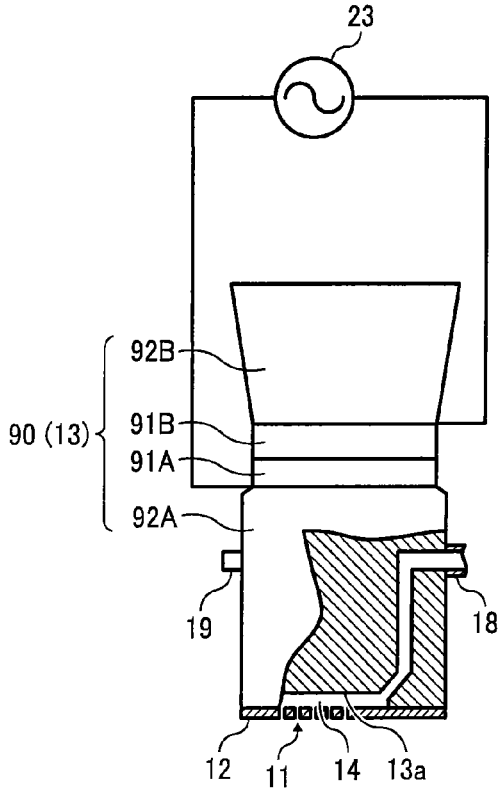
FIG. 8 is an enlarged view of a further embodiment of the droplet spray unit of the toner preparation apparatus in FIG. 1.

In FIG. 8, a bolted Langevin type oscillator 90 formed of piezoelectric bodies 91A and 91B as oscillation generators and horns 92A, in which a reservoir (flow path) 14 is formed, and 92B mechanically and firmly fixed with bolts, as amplifiers is used as the oscillator 13. Frequency conditions occasionally enlarge the piezoelectric body, and as shown in FIG. 8, a fluid inlet/discharge path can be formed in the oscillator and the reservoir can be modified such as a metallic thin film having plural films can be applied to the oscillator 13.

Plurality of the droplet spray units 2 are preferably located above in the granulator 3 (drying tower) in parallel in terms of improving productivity of a toner. The number thereof is preferably from 100 to 1,000 in terms of controllability. In this case, the toner constituent liquid 10 in the material container (common liquid container) 7 is fed through the feeding pipe 8 to the reservoir 14 of each of the droplet spray units 2. The toner constituent liquid 10 from the material container 7 can automatically be fed to the droplet spray unit 2, and the pump 9 subsidiarily can assist feeding the liquid.

Figure 9:
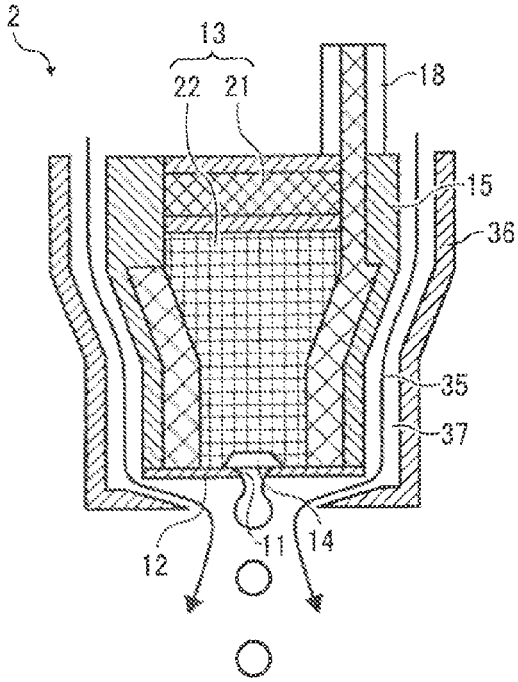
FIG. 9 is an enlarged view of another embodiment of the droplet spray unit of the toner preparation apparatus in FIG. 1.

Another embodiment of the droplet spray unit will be explained, referring to FIG. 9. FIG. 9 is an enlarged view of another embodiment of the droplet spray unit.

Similarly to the above-mentioned embodiment, a droplet spray unit uses a horn oscillator as an oscillation generator 13 and includes a flow path member 15 around the oscillation generator 13 and a reservoir 14 at a position facing a thin film 12 in a horn 22 of the oscillation generator 13. Further, an air flow path forming member 36 forming an air flow path 37 flowing an air stream 35 is located around the flow path member 15 at a required gap between the air flow path forming member 36 and the flow path member 15. In FIG. 9, the thin film 12 has only one nozzle 11 to simplify the drawing, but has plural nozzles as mentioned above.

Figure 10:
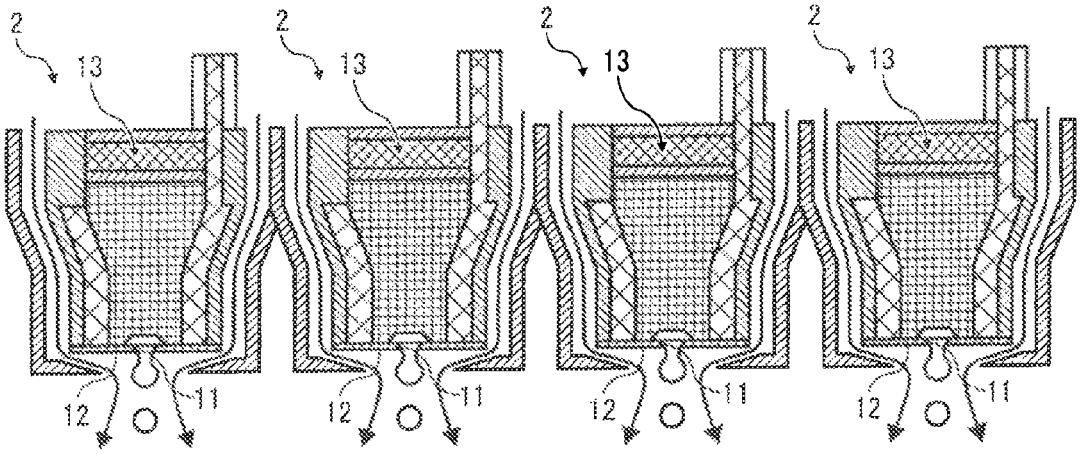
FIG. 10 is schematic view illustrating an arrangement of a plurality of the droplet spray unit in FIG. 9.

Further, as FIG. 10 shows, in order to improve productivity, plural, e.g., 100 to 1,000 pieces of the droplet spray units 2 are preferably located in line at a drying tower reservoir forming a granulator.

Figure 11:
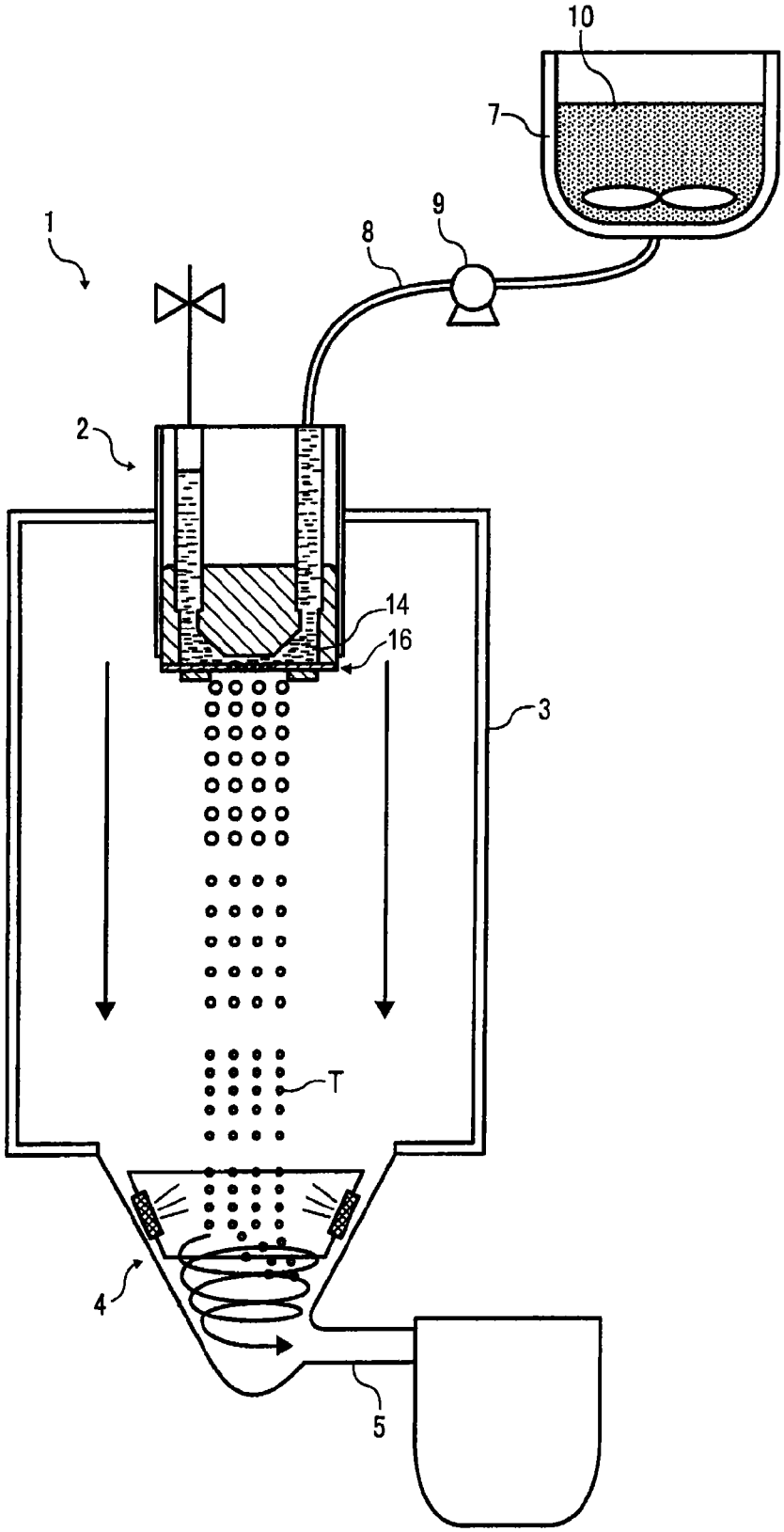
FIG. 11 is a schematic view illustrating another embodiment of the toner preparation apparatus of the present invention.

FIG. 11 is a schematic view illustrating a further embodiment of the toner preparation apparatus of the present invention, in which the droplet spray unit is replaced with a ring droplet spray unit 2.

Figure 12:
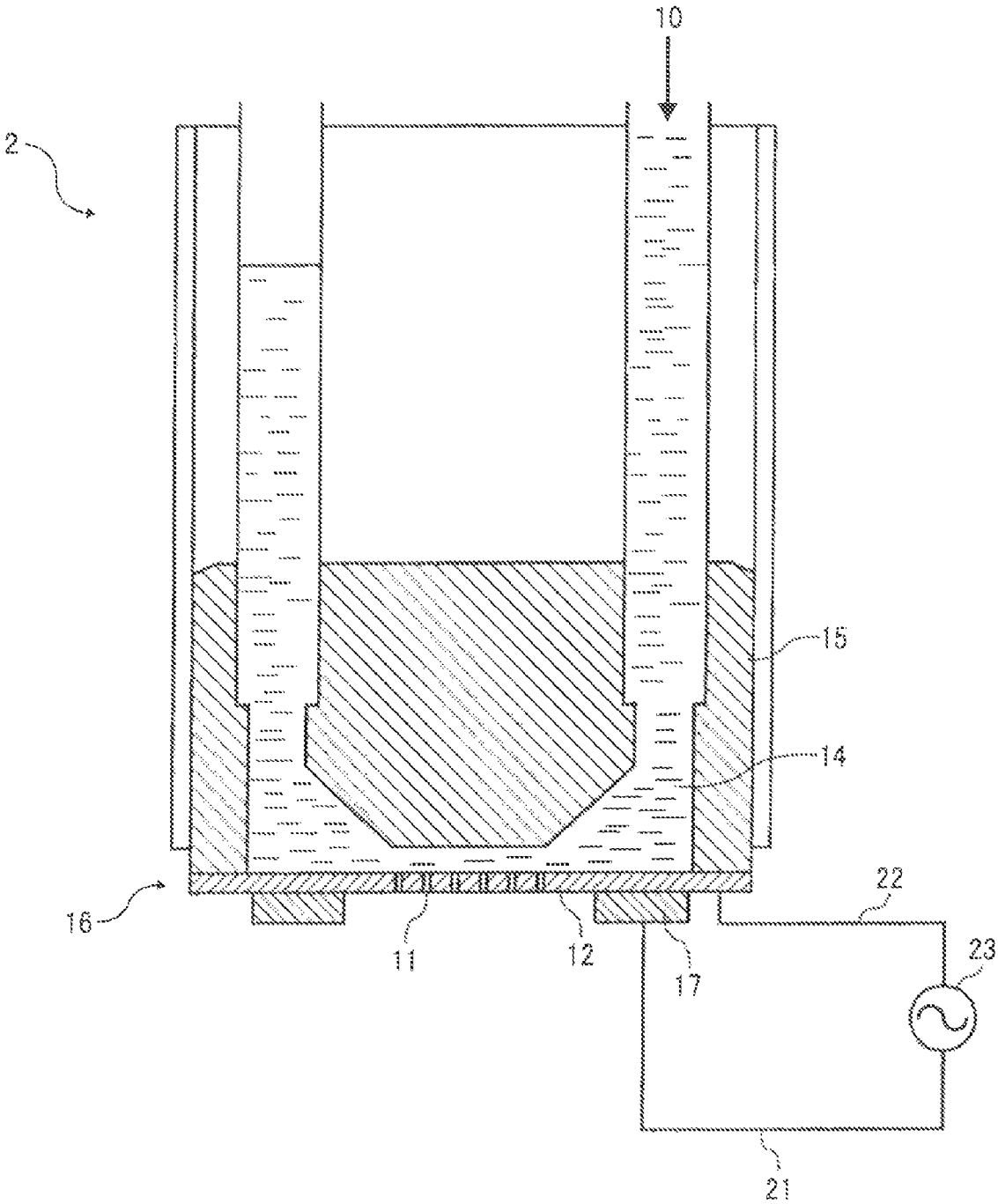
FIG. 12 is an enlarged view of an embodiment of a droplet spray unit of the toner preparation apparatus in FIG. 11.
Figure 13:
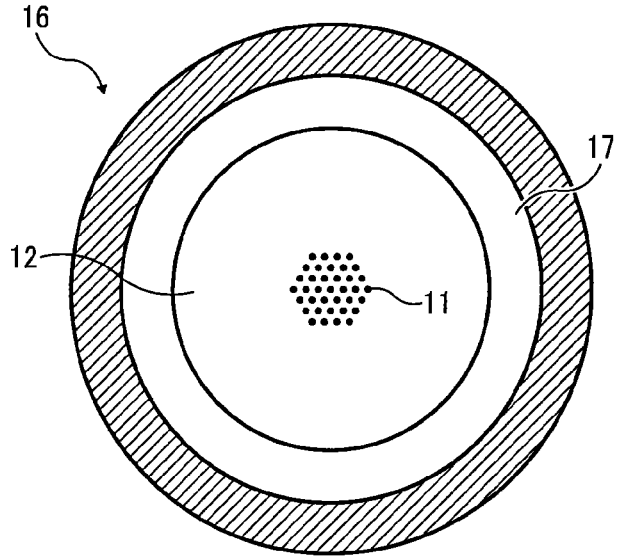
FIG. 13 is a bottom view of the droplet spray unit in FIG. 12.
Figure 14:
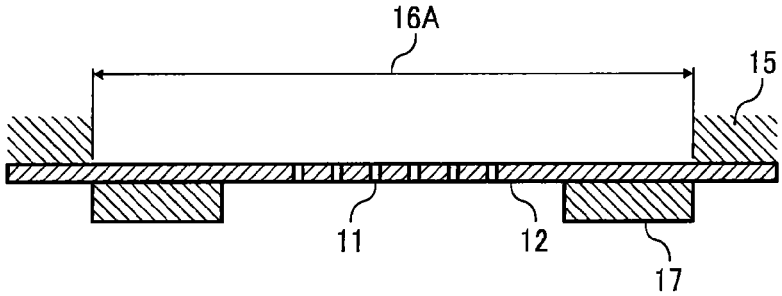
FIG. 14 is an enlarged view of a droplet former of the droplet spray unit in FIG. 12.

The ring droplet spray unit 2 will be explained, referring to FIGS. 12 to 14. FIG. 12 is an enlarged view of the droplet spray unit 2 in FIG. 11, FIG. 13 is a bottom view of the droplet spray unit in FIG. 12, and FIG. 14 is an enlarged view of a droplet former of the droplet spray unit in FIG. 12.

The droplet spray unit 2 includes a droplet former 16 dripping retaining the toner constituent liquid 10 including at least a resin and a colorant, and a flow path member 15 forming a reservoir (liquid flow path) 14 feeding the toner constituent liquid 10 to the droplet former 16.

The droplet former 16 includes a thin film 12 having plural nozzles (discharge holes) 11 and a circular oscillator (electrical mechanical converter) 17 oscillating the thin film 12. An outermost circumference (a shaded area in FIG. 14) of the thin film 12 is fixed on the flow path member 15 with a solder or a binder resin insoluble in the toner constituent liquid. The circular oscillator 17 is located on the circumference of a deformable area 16A (not fixed to the flow path member 15) of the thin film 12. The circular oscillator 17 is applied with a drive voltage (drive signal) having a required frequency from a drive circuit (drive signal generator) 23 through lead wires 21 and 22 to generate a flexural oscillation.

Figure 15:
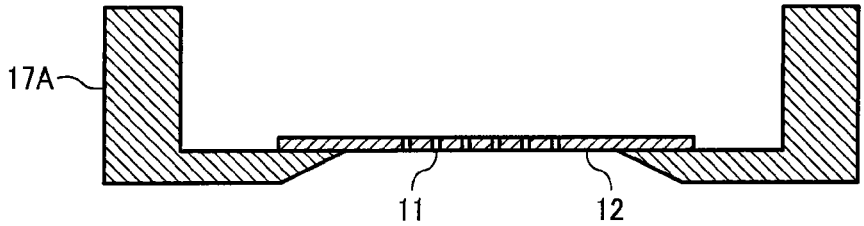
FIG. 15 is an enlarged view of a droplet former of Comparative Example.

The droplet former 16 including the circular oscillator 17 on the circumference of an area where plural nozzles 11 are formed in a deformable area 16A having the plural nozzles 11 lacing the reservoir 14 has a displacement of the thin film 12 larger than that of a dripper including an oscillator 17A holding the circumference of the thin film 12 in FIG. 15. Plural nozzles 11 are located in comparatively a large area having a diameter not less than 1 mm where the large displacement can be obtained, and droplets stably formed and discharged therefrom.

Figure 16:
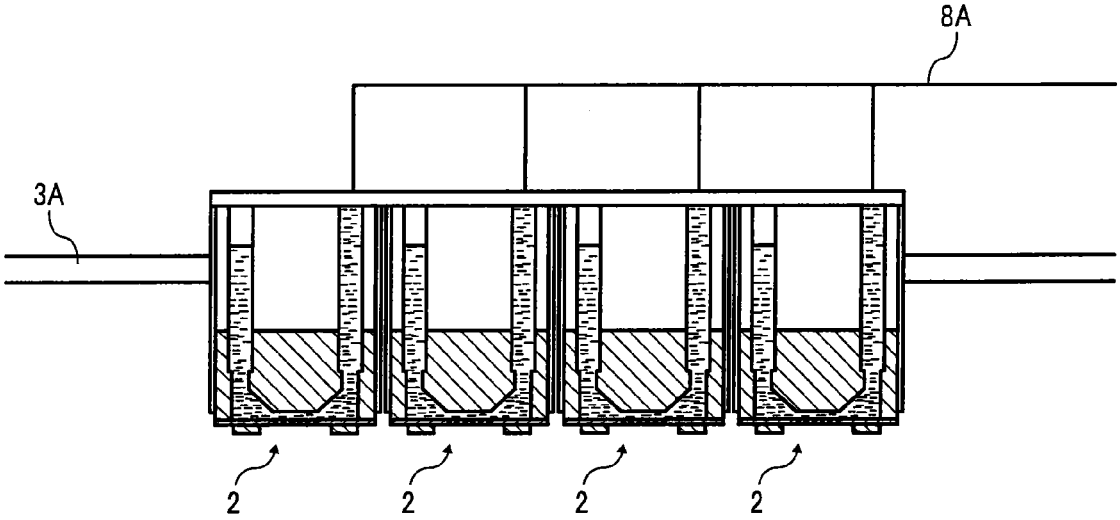
FIG. 16 is a schematic view illustrating a substantial part of the toner preparation apparatus in FIG. 11.

Plurality of the droplet spray units 2 are preferably located on the ceiling 3A in the granulator 3 in terms of improving productivity of a toner. The number thereof is preferably from 100 to 1,000 in terms of controllability as shown in FIG. 16 (only 4 units are shown therein). In this case, the toner constituent liquid 10 in the material container (common liquid container) 7 is fed through the feeding pipe 8A to the reservoir 14 of each of the droplet spray units 2. More droplets can be discharged at the same time to improve the production efficiency.

A droplet forming mechanism by the droplet spray unit 2 will be explained.

As mentioned above, the droplet spray unit 2 transmits a oscillation generated by the oscillator 13 as a mechanical oscillator to the thin film 12 having plural nozzles 11 facing the reservoir 14 to periodically oscillate the thin film 12. The plural nozzles 11 are located in comparatively a large area having a diameter not less than 1 mm, and droplets are periodically and stably formed and discharged therefrom.

Figure 17A:
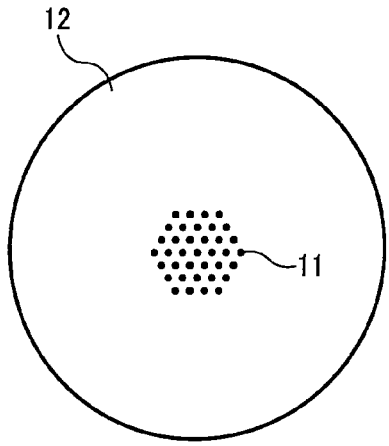
FIGS. 17A and 17B are schematic views illustrating the thin film for explaining the principle of dripping operation by the droplet spray unit in FIG. 12.
Figure 17B:
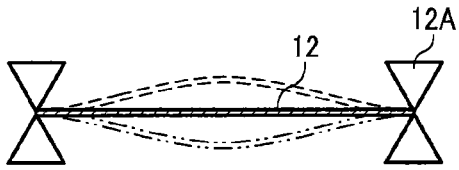
Figure 18:
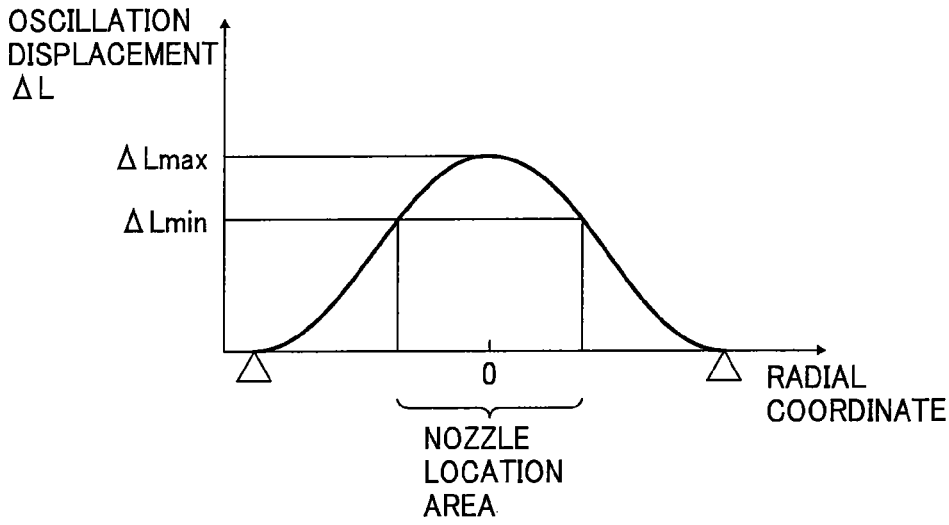
FIG. 18 is an explanatory view of a base oscillation mode of the droplet spray unit in FIG. 12.

When a simple circular thin film 12 having a fixed circumference 12A as shown in FIG. 17 is oscillated, a basic oscillation has a displacement $\Delta L$ becoming maximum ($\Delta L_{max}$) at the center ○ of the thin film 12 as shown in FIG. 18 while the circumference is a joint and the thin film 12 periodically oscillates up and down.

Figure 19:
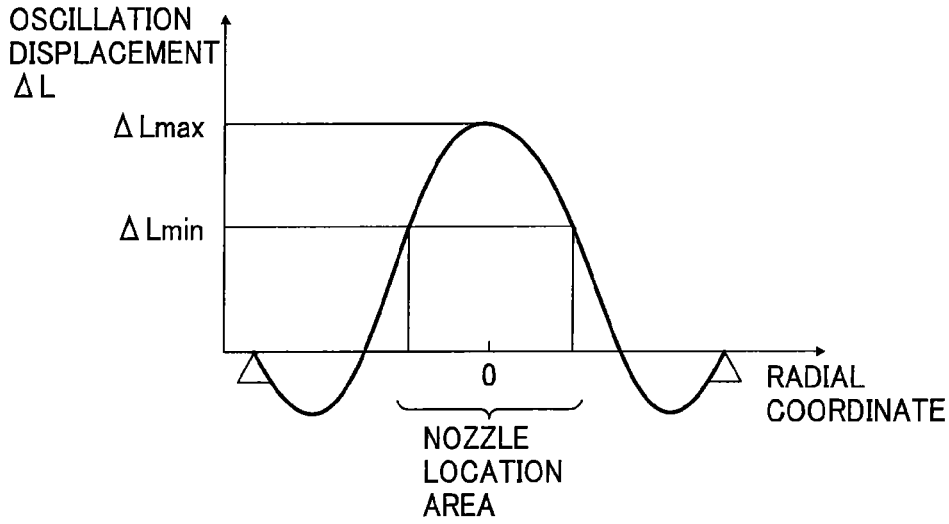
FIG. 19 is an explanatory view of a secondary oscillation mode of the droplet spray unit in FIG. 12.
Figure 20:
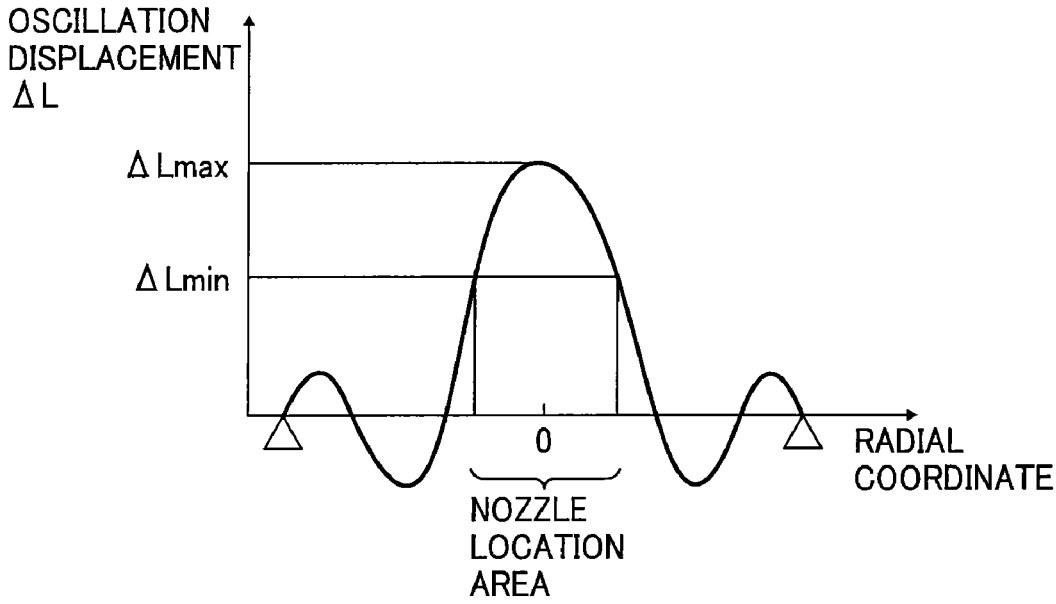
FIG. 20 is an explanatory view of a third oscillation mode of the droplet spray unit in FIG. 12.
Figure 21:
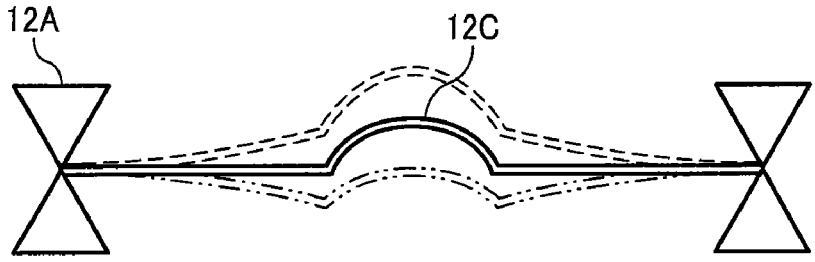
FIG. 21 is a schematic view illustrating the thin film having a convexity at the center of the droplet spray unit in FIG. 12.

As shown in FIGS. 19 and 20, higher oscillation modes are known. These modes concentrically have one or plural joints in a circular thin film 12 and substantially has a symmetric deformed configuration in the radial direction. In addition, as shown in FIG. 21, when the circular thin film 12 has a convex center 12C, a traveling direction of the droplet and the amplitude can be controlled.

When the circular thin film 12 oscillates, the (toner constituent) liquid close to the plural nozzles 11 formed on the circular thin film 12 has a pressure Pac proportional to an oscillation speed Vm of the thin film 12. A sound pressure is known to generate as a radiation impedance Zr of a medium (toner constituent liquid), and the pressure is determined by the following formula:

$$\mathrm{Pac}(r,t)=Zr\cdot Vm(r,t) \quad (1).$$

The oscillation speed Vm of the thin film 12 is a function of time (t) because of periodically varying with time, and can form various periodical variations such as a sine waveform and a rectangle waveform. In addition, as mentioned above, every part of the thin film 12 has a different oscillation displacement and the oscillation speed Vm is also a function of a position coordinate on the thin film 12. An oscillation form of the thin film 12 is preferably a symmetric deformed configuration in the radial direction as mentioned above, and substantially a function of a radius (r) coordinate.

As mentioned above, an acoustic pressure proportional to an oscillation displacement speed having a distribution of the thin film 12 is generated and the toner constituent liquid 10 is discharged to a gas phase in accordance with a periodical change of the acoustic pressure.

Since the toner constituent liquid 10 periodically discharged to the gas phase becomes spherical due to a difference of surface tensions between the liquid phase and the gas phase, the toner constituent liquid 10 is periodically formed to a droplet and discharged from the plural nozzles 11.

The thin film 12 preferably has an oscillation frequency of from 20 kHz to 2.0 MHz, and more preferably from 50 to 500 kHz. The oscillation frequency not less than 20 kHz accelerates dispersion of a pigment and a wax in the toner constituent liquid 10.

Further, the dispersion of a pigment and a wax is more preferably accelerated when the toner constituent liquid 10 has a pressure not less than 10 kPa.

The droplet has a larger diameter as the oscillation displacement in an area where the plural nozzles 11 are formed becomes larger. When the oscillation displacement is small, a small droplet is formed or the toner constituent liquid 10 is not dripped. In order to reduce variation of the droplet sizes in an area where the plural nozzles 11 are formed, the plural nozzles 11 need to be located such that the thin film 12 has the most suitable oscillation displacement.

In the present invention, when the plural nozzles 11 are located such that the oscillation of the thin film 12 the oscillator 13 generates has a ratio R (ΔLmax/ΔLmin) of a maximum (ΔLmax) to a minimum (ΔLmin) of the oscillation direction displacement not greater than 2.0 in an area the plural nozzles are formed as shown in FIGS. 18 to 20, i.e., when the plural nozzles 11 are located in an area where R is not greater than 2.0, the droplet size variation can be in a range of toner particle sizes required to produce high-quality images.

Meanwhile, when the toner constituent liquid has a viscosity not greater than 20 mPa·s and surface tension of from 20 to 75 mN/m, a satellite generates. Therefore, the toner constituent liquid 10 preferably has an acoustic pressure not greater than 500 kPa, and more preferably not greater than 100 kPa to prevent the satellite from generating. The thin film having nozzles is a member discharging a toner constituent solution or dispersion to form a droplet.

The materials of the thin film 12 and the shape of the nozzle 11 are not particularly limited, and it is preferable that the thin film is formed of a metallic plate having a thickness of from 5 to 500 μm and that the nozzle has an opening diameter of from 3 to 35 μm in terms of spraying microscopic droplets of the toner constituent liquid 10 having a uniform diameter from the nozzle 11. The opening diameter of the nozzle 11 is a diameter for a perfect circle and a minor diameter for an ellipse. The number of the nozzles is preferably from 2 to 3,000.

The droplet is discharged in a gas such as heated dry nitrogen to remove a solvent therefrom. The droplet is further subjected to second drying such as fluidized-bed drying and vacuum drying if desired.

Easily dryable solvents dissolving a binder resin are used as the organic solvent dissolving or dispersing at least the binder resin and a colorant. Ethers, ketones, esters, hydrocarbons and alcohols are preferably used, and particularly tetrahydrofuran, acetone, methyl ethyl ketone, ethylacetate, toluene, methanol and ethanol are preferably used. These can be used alone or in combination.

The smaller the particle diameter of the toner, the more improved the reproducibility of dots and thin lines, and sharp and high-definition images without roughness are produced. However, when too small, an apparent adherence increases, resulting in deterioration of developability and transferability. Therefore, the toner preferably has a weight-average particle diameter of from 1 to 15 μm, more preferably from 2 to 10 μm, and furthermore preferably from 3 to 8 μm.

The particle diameter distribution is represented by a ratio of a weight-average particle diameter (D4) to a number-average particle diameter (Dn). When D4/Dn is 1, the toner is a mono-dispersed toner having an even particle diameter. D4/Dn of a pulverized toner is typically from 1.2 to 1.4 so as not to decrease productivity thereof.

The electrophotographic developing methods are broadly classified to one-component developing methods and tow-component developing methods. In any of the developing methods, particle diameters easily developable are present and the toner remaining in an image developer varies in the particle diameter and particle diameter distribution when repeatedly developed, resulting in variation of image quality. Therefore, the particle diameter distribution is preferably as narrow as possible. To stably produce quality images even when repeatedly produced, Dw/Dn is preferably from 1.00 to 1.15, and more preferably from 1.00 to 1.10.

Conventionally known binder resins for toner are used as the binder resin. The binder resin has a ratio (Mw/Mn) of a weight-average molecular weight (Mw) to a number-average molecular weight (Mn) of THF(tetrahydrofuran)-soluble components of from 1.5 to 15 in a molecular weight distribution measured by GPC (gel permeation chromatography), and a ½ flow temperature (Tm) of from 114 to 149° C.

When plural binder resins are used, an integrated Tm of each resin per each weight is from 114 to 149° C.

Conventionally, a polymeric resin having a weight-average molecular weight not less than 100,000 or a crosslinked resin is blended with a binder resin to increase viscoelasticity thereof in order to impart hot offset resistance to the resultant toner. However, such resins are not fully dissolved in a solvent and the resultant liquid has high melt viscosity even when the resins are dissolved, resulting in significant deterioration of the sprayability.

When the polymeric resin or the crosslinked resin is simply removed to improve sprayability, Tm of the binder resin deteriorates, resulting in hot offset problem. In order to prevent hot offset, the binder resin needs to have a Tm not less than 114° C., and not greater than 149° C. for color reproducibility of color toners. A binder resin having such a range of Tm and a ratio (Mw/Mn) of a weight-average molecular weight (Mw) to a number-average molecular weight (Mn) of THF(tetrahydrofuran)-soluble components of from 1.5 to 15 in a molecular weight distribution measured by GPC (gel permeation chromatography) enables the resultant liquid to have good sprayability and the resultant toner to have hot offset resistance.

Including components such as a pigment besides a binder resin, a toner has a Tm about 1° C. higher than that of the binder resin. Therefore, a toner has a Tm of from 115 to 150° C. when a binder resin included therein has a Tm of from 114 to 149° C.

In order to enable the resultant liquid to have good sprayability and the resultant toner to have hot offset resistance, the binder resin preferably has a peak molecular weight (Mp) of from 6,000 to 50,000, and more preferably from 8,000 to 30,000. When less than 6,000, the offset resistance is occasionally insufficient. When greater than 50,000, the sprayability is occasionally insufficient. The binder resin preferably includes components having a molecular weight not less than 100,000 in an amount not greater than 20%, and more preferably not greater than 15% because the sprayability extremely deteriorates when polymeric components increase.

Further, the binder resin preferably has no crosslinked structure because it is required to be soluble in a solvent.

Specific examples of the resins include vinyl polymers including styrene monomers, acrylic monomers or methacrylic monomers, or copolymers including two or more of the monomers; polyester resins; a polyol resin; a phenol resin; a silicone resin; a polyurethane resin; a polyamide resin; a furan resin; an epoxy resin; a xylene resin; a terpene resin; a coumarone-indene resin; a polycarbonate resin; a petroleum resin; etc.

Among these resins, copolymers of styrene monomers and (meth)acrylic monomers, and polyester resins are preferably used.

Specific examples of the styrene monomers include styrenes or their derivatives such as styrene, o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dochlorostyrne, m-nitrostyrene, o-nitrostyrene and p-nitrostyrene.

Specific examples of the acrylic monomers include an acrylic acid or their esters such as methylacrylate, ethylacrylate, n-butylacrylate, isobutylacrylate, n-octylacrylate, n-dodecylacrylate, 2-ethylhexylacrylate, stearylacrylate, 2-chloroethylacrylate and phenylacrylate.

Specific examples of the methacrylic monomers include a methacrylic acid or their esters such as a methacrylic acid, methylmethacrylate, ethylmethacrylate, propylmethacrylate, n-butylmethacrylate, isobutylmethacrylate, n-octylmethacrylate, n-dodecylmethacrylate, 2-ethylhexylmethacrylate, stearylmethacrylate, phenylmethacrylate, dimethylaminoethylmethacrylate and diethylaminoethylmethacrylate.

Specific examples of polymerization initiators used for preparing the vinyl polymer or copolymer include azo polymerization initiators such as 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutylate, 1,1'-azobis(cyclohexanecarbonitrile), 2-(carbamoylazo)-isobutyronitrile, 2,2'-azobis(2,4,4-trimethylpentane), 2-phenylazo-2',4'-fimethyl-4'-methoxyvaleronitrile and 2,2'-azobis(2-methylpropane); ketone peroxides such as methyl ethyl ketone peroxide, acetylacetone peroxide and cyclohexanone peroxide; 2,2-bis(tert-butylperoxy)butane; tert-butylhydroperoxide; cumenehydroperoxide; 1,1,3,3-tetramethylbutylhydroperoxide; di-tert-butylperoxide; tert-butylcumylperoxide; di-cumylperoxide; α-(tert-butylperoxy)isopropylbenzene; isobutylperoxide; octanoylperoxide; decanoylperoxide; lauroylperoxide; 3,5,5-trimethylhexanoylperoxide; benzoylperoxide; m-tolylperoxide; di-isopropylperoxydicarbonate; di-2-ethylhexylperoxydicarbonate; di-n-propylperoxydicarbonate; di-2-ethoxyethylperoxycarbonate; di-ethoxyisopropylperoxydicarbonate; di(3-methl-3-methoxybutyl)peroxycarbonate; acetylcyclohexylsulfonylperoxide; tert-butylperoxyacetate; tert-butylperoxyisobutylate; tert-butylperoxy-2-ethylhexalate; tert-butylperoxylaurate; tert-butyloxybenzoate; tert-butylperoxyisopropylcarbonate; di-tert-butylperoxyisophthalate; tert-butylperoxyallylcarbonate; isoamylperoxy-2-ethylhexanoate; di-tert-butylperoxyhexahydroterephthalate; tert-butylperoxyazelate; etc.

Specific examples of monomers forming polyester polymers include the following materials.

Specific examples of bivalent alcohol include diols such as ethyleneglycol, propyleneglycol, 1,3-butanediol, 1,4-butanediol, 2,3-butanediol, 1,4-butenediol, diethyleneglycol, triethyleneglycol, 1,5-pentanediol, 1,6-hexanediol, neopentylglycol, 2-ethyl-1,3-hexanediol, and diols formed by polymerizing hydrogenated bisphenol A or bisphenol A with cyclic ethers such as an ethylene oxide and a propylene oxide.

Specific examples of acids forming the polyester polymers include benzene dicarboxylic acids or their anhydrides such as a phthalic acid, an isophthalic acid and a terephthalic acid; alkyl dicarboxylic acids or their anhydrides such as a succinic acid, an adipic acid, a sebacic acid and an azelaic acid; unsaturated diacids such as a maleic acid, a citraconic acid, an itaconic acid, an alkenylsuccinic acid, a fumaric acid and a mesaconic acid; and unsaturated diacid anhydrides such as a maleic acid anhydride, a citraconic acid anhydride, an itaconic acid anhydride and an alkenylsuccinic acid anhydride; etc. Specific examples of polycarboxylic acids having 3 or more valences include a trimellitic acid, a pyromellitic acid, a 1,2,4-benzenetricarboxylic acid, a 1,2,5-benzenetricarboxylic acid, a 2,5,7-naphthalenetricarboxylic acid, a 1,2,4-naphthalenetricarboxylic acid, a 1,2,4-butanetricarboxylic acid, a 1,2,5-hexanetricarboxylic acid, a 1,3-dicarboxyl-2-methylmethylenecarboxypropane, tetra(methylenecarboxyl)methane, 1,2,7,8-octantetracarboxylic acids, empol trimer or their anhydrides, or those partially replaced with lower alkyl esters, etc.

The binder resins preferably have a glass transition temperature (Tg) of from 35 to 80° C., and more preferably from 40 to 75° C. in terms of the storage stability of the resultant toner. When lower than 35° C., the resultant toner is likely to deteriorate in an environment of high temperature, and have offset problems when fixed. When higher than 80° C., the fixability thereof occasionally deteriorates.

Specific examples of the colorants for use in the present invention include any known dyes and pigments such as carbon black, Nigrosine dyes, black iron oxide, NAPHTHOL YELLOWS, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and their mixtures.

The toner preferably includes the colorant in an amount of from 1 to 15% by weight, and more preferably from 3 to 10% by weight.

The colorant for use in the present invention can be used as a masterbatch when combined with a resin. Specific examples of the resin used in the masterbatch or used with the masterbatch include the modified and unmodified polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylatecopolymers, styrene-butylmethacrylatecopolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The masterbatch can be prepared by mixing and kneading a resin and a colorant upon application of high shearing stress thereto. In this case, an organic solvent is preferably used to increase interactions between the colorant and the resin. In addition, flushing methods, where in an aqueous paste including a colorant is mixed with a resin solution of an organic solvent to transfer the colorant to the resin solution and then the aqueous liquid and organic solvent are separated and removed, is preferably used because the resultant wet cake of the colorant can be used as it is. A three roll mill is preferably used for kneading the mixture upon application of high shearing stress.

The toner preferably includes the colorant in an amount of from 2 to 30 parts by weight per 100 parts by weight of the binder resin.

The masterbatch preferably includes a resin having an acid value not greater than 30 mg KOH/g and an amine value of from 1 to 100 and a colorant dispersed therein, and more preferably includes a resin having an acid value not greater than 20 mg KOH/g and an amine value of from 10 to 50 and a colorant dispersed therein. When the acid value is greater than 30 mg KOH/g, the chargeability of the resultant toner occasionally deteriorates due to high humidity and the colorant is insufficiently dispersed in the masterbatch occasionally. When the amine value is less than 1 and greater than 100, the colorant is insufficiently dispersed in the masterbatch occasionally. The acid value is measured by the method disclosed in JIS K0700 and the amine value in JIS K7237.

A dispersant preferably has high compatibility with a binder resin in terms of pigment dispersibility. Specific examples of marketed products thereof include AJISPER PB821 and AJISPER PB822 from Ajinomoto Fine-Techno Co., Inc.; Disperbyk-2001 from BYK-Chemie GmbH; and EFKA-4010 from EFKA ADDITIVES.

The dispersant preferably has a weight-average molecular weight, i.e., a molecular weight at a maximum main peak in the gel permeation chromatography of a styrene-converted weight, of from 500 to 100,000, more preferably from 3,000 to 100,000, furthermore preferably from 5,000 to 50,000, and most preferably form 5,000 to 30,000 in terms of pigment dispersibility. When less than 500, the dispersant has high polarity, resulting in occasional dispersibility deterioration of the colorant. When greater than 100,000, the dispersant has high affinity with a solvent, resulting in occasional dispersibility deterioration of the colorant.

The dispersant is preferably included in the masterbatch in an amount of from 1 to 50 parts, and more preferably from 5 to 30 parts by weight per 100 parts by weight of the colorant. When less than 1 part by weight, the dispersibility of the dispersant deteriorates. When greater than 50 parts by weight, the chargeability of the resultant toner occasionally deteriorates.

A wax may be included in the toner of the present invention as a release agent to prevent offset when fixed.

Any known waxes can be used, and specific examples thereof include aliphatic hydrocarbon waxes such as low-molecular-weight polyethylene, low-molecular-weight polypropylene, a polyolefin wax, a microcrystalline wax, a paraffin wax and a sasol wax; aliphatic hydrocarbon wax oxides such as polyethylene oxide wax or their block copolymers; plant waxes such as a candelilla wax, a carnauba wax, a Japan wax, and a jojoba wax; animal waxes such as a bees wax, a lanolin and a whale wax; mineral waxes such as an ozokerite, a ceresin and a petrolatum; waxes mainly including fatty ester such as a montanic acid ester wax and a mosquito star wax; and waxes having partially or wholly deacidified fatty ester.

Specific examples of the wax further include saturated straight-chain fatty acids such as a palmitic acid, a stearic acid, a montanic acid and a straight-chain alkyl carboxylic acid having a straight-chain alkyl group; unsaturated fatty acids such as an eleostearic acid; saturated alcohols such as stearyl alcohol, behenyl alcohol, ceryl alcohol, mesilyl alcohol and long-chain alkyl alcohol; polyalcohols such as sorbitol; fatty acid amides such as linoleic amide, olefinic amide and lauric amide; saturated fatty acid bismaides such as methylenebisamide caprate, lauric ethylenebisamide and stearic hexamethylenebisamide; unsaturated fatty acid amides such as oleic ethylenebisamide, oleic hexamethylenebisamide, adipic N, N'-dioleylamide and sebacic N,N'-dioleylamide; aromatic bismaides such as stearic m-xylenebisamide and isophthalic N,N-distearylamide; fatty acid metal salts such as calcium stearate, calcium laurate, zinc stearate and magnesium stearate; an aliphatic hydrocarbon wax grafted with a vinyl monomer such as styrene and an acrylic acid; a partially esterified compound of fatty acids such as monoglyceride behenate and polyalcohol; and a methyl ester compound having a hydroxyl group, formed by adding a hydrogen atom to a vegetable oil.

Preferred waxes include polyolefin formed by radically polymerizing olefin under high pressure; polyolefin formed by refining a low-molecular-weight byproduct when polymerizing high-molecular-weight polyolefin; polyolefin formed by polymerizing olefin with a catalyst such as a Ziegler catalyst and a metallocene catalyst under low pressure; polyolefin formed by polymerizing olefin using a radiation, an electromagnetic ray or light; low-molecular-weight polyolefin formed by pyrolyzing high-molecular-weight polyolefin; a paraffin wax; a microcrystalline wax; a Fischer-Tropsh wax; synthetic hydrocarbon waxes synthesized by a synthol method, a hydronalium call method, etc.; synthetic waxes having a monomer having a carbon atom; hydrocarbon waxes having a functional group such as a hydroxyl group or a carboxyl group; mixtures of hydrocarbon waxes and hydrocarbon waxes having a functional group; and waxes graft-modified with a vinyl monomer such as styrene, ester maleate, acrylate, methacrylate and maleic acid anhydride.

In addition, these waxes having sharper molecular weight distributions after subjected to a press sweating process, a solvent process, a recrystallization process, a vacuum distillation process, a supercritical gas extraction process or a solution crystallization process are preferably used. Further, waxes, wherein low-molecular-weight fatty acids, low-molecular-weight solid alcohols, low-molecular-weight solid compounds and other impurities are removed from these waxes, are preferably used as well.

The wax preferably has a melting point of from 70 to 140° C., and more preferably from 70 to 120° C. to balance the fixability and offset resistance of the resultant toner. When lower than 70° C., blocking resistance thereof tends to deteriorate. When higher than 140° C., the offset resistance thereof is difficult to develop.

The melting point of the wax is the maximum endothermic peak when measured by a DSC method.

The endothermic peak of the wax or toner is preferably measure by a high-precision inner-heat input-compensation differential scanning calorimeter. The measurement method is based on ASTM D3418-82. ADSC curve measured when the temperature is increased at 10° C./min after increasing and decreasing the temperature is used.

The toner of the present invention preferably includes a release agent in an amount of from 1 to 30% by weight, and more preferably from 2 to 20% by weight.

The toner of the present invention may include a charge controlling agent if desired. Specific examples of the charge controlling agent include any known charge controlling agents, preferably colorless or almost white materials because of not changing the color tone of the toner, such as Nigrosine dyes, triphenylmethane dyes, metal complex dyes including chromium, molybdic acid chelate pigments, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, and metal salts of salicylic acid and of salicylic acid derivatives. Specifically, a quaternary ammonium salt BONTRON P-51, a metal complex of oxynaphthoic acids E-82, a metal complex of salicylic acids E-84 and a phenolic condensation product E-89, which are manufactured by Orient Chemical Industries Co., Ltd.; molybdenum complex of quaternary ammonium salts TP-302 and TP-415, which are manufactured by Hodogaya Chemical Co. Ltd.; a quaternary ammonium salt COPY CHARGE PSY VP2038, a triphenyl methane derivative COPY BLUE, quaternary ammonium salts COPY CHARGE NEG VP2036 and NX VP434, which are manufactured by Hoechst AG; LRA-901 and a boron complex LR-147, which are manufactured by Japan Carlit Co., Ltd.; quinacridone; azo pigments; polymeric compounds having functional groups such as a sulfonic acid group, a carboxyl group and a quaternary ammonium salt; etc. can be used.

The content of the charge controlling agent is determined depending on the species of the binder resin used, whether or not an additive is added and toner manufacturing method (such as dispersion method) used, and is not particularly limited. However, the content thereof is typically from 0.1 to 10 parts by weight, and preferably from 0.2 to 5 parts by weight, per 100 parts by weight of the binder resin included in the toner. When less than 0.1 parts by weight, the chargeability of the resultant toner possibly deteriorates. When greater than 10 parts by weight, the toner has too large charge quantity, and thereby the electrostatic force of a developing roller attracting the toner increases, resulting in deterioration of the fluidity of the toner and image density of the toner images.

The toner of the present invention can be a magnetic toner including a magnetic material if desired. Specific examples of magnetic materials for use in the present invention include (1) magnetic iron oxides such as magnetite, maghematite and ferrite and iron oxides including other metal oxides; (2) metals such as iron, cobalt and nickel or their metal alloys with metals such as aluminum, cobalt, copper, lead, magnesium, tin, zinc, antimony, beryllium, bismuth, cadmium, calcium, manganese, selenium, titanium, tungsten and vanadium; and (3) their mixtures.

Specific examples thereof include $Fe_3O_4$, $\gamma$-$Fe_2O_3$, $ZnFe_2O_4$, $Y_3Fe_5O_{12}$, $CdFe_2O_4$, $Gd_3Fe_5O_{12}$, $CuFe_2O_4$, $PbFe_{12}O$, $NiFe_2O_4$, $NdFe_2O$, $BaFe_{12}O_{19}$, $MgFe_2O_4$, $MnFe_2O_4$, $LaFeO_3$, an iron powder, a cobalt powder, a nickel powder, etc. These can be used alone or in combination. Particularly, fine powders of $Fe_3O_4$ and $\gamma$-$Fe_2O_3$ are preferably used.

In addition, magnetic iron oxides such as magnetite, maghematite and ferrite including a heterogeneous element or their mixtures can also be used. Specific examples of the heterogeneous element include lithium, beryllium, boron, magnesium, aluminum, silicon, phosphorus, germanium, zirconium, tin, sulfur, calcium, scandium, titanium vanadium, chrome, manganese, cobalt, nickel, copper, zinc, gallium, etc. Particularly, magnesium, aluminum, silicon, phosphorus or zirconium is preferably used. The heterogeneous element may be taken in a crystal lattice of the iron oxide or therein as an oxide. Alternatively, the heterogeneous element may be present on the surface thereof as an oxide or a hydroxide. The heterogeneous element is preferably included there in as an oxide.

The heterogeneous element can be taken in a magnetic material by mixing a salt thereof when preparing the magnetic material and performing a pH control. In addition, the heterogeneous element can be separated out on the surface of a magnetic material by performing the pH control or adding the salt thereof and performing the pH control after preparing the magnetic material.

The toner preferably includes the magnetic material in an amount of from 10 to 200 parts by weight, and more preferably from 20 to 150 parts by weight per 100 parts by weight of the binder resin. The magnetic material preferably has a number-average particle diameter of from 0.1 to 2 μm, and more preferably from 0.1 to 0.5 μm. The number-average particle diameter can be determined by measuring a photograph thereof, zoomed by a transmission electron microscope, with a digitizer, etc.

The magnetic material preferably has a coercivity of from 2 to 150 Oe, a saturated magnetization of from 50 to 200 emu/g and a residual magnetization of from 2 to 20 emu/g when applied with 10 k Oe.

The magnetic material can be used as a colorant as well.

The toner constituent liquid is a liquid formed of a solvent, and the above toner constituent are dissolved or dispersed therein. The toner constituent liquid preferably includes solid contents of from 5 to 40% by weight. When less than 5% by weight, not only the productivity lowers, but also the constituents such as pigments, waxes, magnetic materials and charge controlling agents are likely to settle out or agglutinate, resulting in uneven quality of the resultant toner particles. When greater than 40% by weight, the sprayability deteriorates and the liquid cannot be sprayed occasionally.

The toner constituent liquid preferably has a viscosity of from 0.5 to 10 mPa·s, and more preferably from 0.7 to 8 mPa·s when measured by a rotor viscometer.

The toner of the present invention may include a fluidity improver. The fluidity improver is added to the surface thereof to improve the fluidity thereof.

Specific examples thereof include fluorine-containing resin powders such as carbon black, a vinylidene fluoride fine powder and a polytetrafluoroethylene fine powder; a silica fine powder such as a wet method silica and a dry method silica; a titanium oxide fine powder; an alumina fine powder; and a surface-treated silica, a surface-treated titanium oxide and a surface-treated alumina with a silane coupling agent, a titanium coupling agent or a silicone oil. Particularly, the silica fine powder, titanium oxide fine powder and alumina fine powder are preferably used. The surface-treated silica with a silane coupling agent or a silicone oil is more preferably used.

The fluidity improver preferably has an average primary particle diameter of from 0.001 to 2 μm, and more preferably from 0.002 to 0.2 μm.

Preferred silica fine powders include a fine powder prepared by vapor-phase oxidizing a silicon halogen compound, i.e. a dry method silica or a fumed silica.

Specific examples of the marketed silica fine powders include AEROSIL-130, -300, -380, -TT600, -MOX170, -MOX80 and -COK84 from NIPPON AEROSIL CO., LTD.; Ca-O-SiL-M-5, -MS-7, -MS-75, -HS-5 and -EH-5 from Cabot Corp.; Wacker HDK-N20, -V15, -N20E, -T30 and -T40 from WACKER-CHEMIEGMBH; D-CFineSilica from Dow Corning Corp.; and Fansol from Fransil.

The silica fine powder prepared by vapor-phase oxidizing a silicon halogen compound is preferably hydrophobized. The hydrophobized silica fine powder preferably has a hydrophobicity of from 30 to 80% when measured by a methanol titration method. The silica fine powder is chemically or physically hydrophobized with an organic silicon compound.

Specific examples thereof include hydroxypropyltrimethoxysilane, phenyltrimethoxysilane, n-hexadecyltrimethoxysilane, n-octadecyltrimethoxysilane, vinylmethoxysilane, vinyltriethoxysilane, vinyltriacetoxysilane, dimethylvinylchlorosilane, divinylchlorosilane, γ-methacryloxypropyltrimethoxysilane, hexamethyldisilane, trimethylsilane, trimethylchlorosilane, dimethyldichlorosilane, methyltrichlorosilane, allyldimethylchlorosilane, allylphenyldichlorosilane, benzyldimethylchlorosilane, bromomethyldimethylchlorosilane, α-chlorethyltrichlorosilane, β-chloroethyltrichlorosilane, chloromethyldimethylchlorosilane, triorganosilylmercaptan, trimethylsilylmercaptan, triorganosilylacrylate, vinyldimethylacetoxysilane, dimethyletoxysilane, trimethyletoxysilane, trimethylmetoxysilane, methyltrietoxysilane, isobutyltrimetoxysilane, dimethyldimethoxysilane, diphenyldiethoxysilane, hexamethyldisiloxane, 1,3-divinyltetramethyldisiloxane, 1,3-diphenyltetramethyldisiloxane, dimethylpolysiloxane having 2 to 12 siloxane units and 0 to 1 hydroxyl group bonded with Si at the end unit, etc. Further, silicone oils such as a dimethyl silicone oil can also be used. This can be used alone or in combination.

The fluidity improver preferably has a number-average particle diameter of from 5 to 100 nm, and more preferably from 5 to 50 nm.

The fluidity improver preferably has a specific surface area not less than 30 $m^2/g$, and more preferably from 60 to 400 $m^2/g$ when measured by a BET nitrogen absorption method. When a surface-treated fine powder, the fluidity improver preferably has a specific surface area not less than 20 $m^2/g$, and more preferably from 40 to 300 $m^2/g$.

The fluidity improver is preferably included in a toner in an amount of from 0.03 to 8 parts by weight per 100 parts by weight of the toner.

The toner of the present invention may include a cleanability improver for removing a developer remaining on a photoreceptor and a first transfer medium after transferred. Specific examples of the cleanability improver include fatty acid metallic salts such as zinc stearate, calcium stearate and stearic acid; and polymer particulate materials prepared by a soap-free emulsifying polymerization method such as a polymethylmethacrylate particulate material and a polystyrene particulate material. The polymer particulate materials comparatively have a narrow particle diameter distribution and preferably have a weight-average particle diameter of from 0.01 to 1 μm.

The fluidity improvers and cleanability improvers are called external additives as well because they adhere to or are fixed on the surface of a toner. A typical powder mixer is used to externally add them to a toner. Specific examples of the mixers include V-type Mixer, Rocking Mixer, LOEDIGE MIXER, NAUTA MIXER and HENSCHEL MIXER. Hybridizers, MECHANOFUSION, Q-mixers, etc. are used to fix them on a toner.

The toner of the present invention may be mixed with a carrier and used as a two-component developer. Conventional carriers such as ferrite and magnetite, and resin-coated carriers can be used.

The resin-coated carrier is formed of a carrier core material and a coating material, i.e., a resin coating the surface of the carrier core material.

Specific examples of the resin include styrene-acrylic resins such as a styrene-esteracrylate copolymer and a styrene-estermethacrylate copolymer; acrylic resins such as an ester-acrylate copolymer and an estermethacrylate copolymer; fluorine-containing resins such as polytetrafluoroethylene, monochlorotrifluoroethylene polymer and polyvinylidene-fluoride; a silicone resin; a polyester resin; a polyamide resin; polyvinylbutyral; and an aminoacrylate resin. Besides, any resins such as an ionomer resin and a polyphenylenesulfide resin usable as a coating material for a carrier can be used. These can be used alone or in combination. In addition, a binder carrier core, wherein a magnetic powder is dispersed in a resin, can also be used.

Methods of coating a resin coating material on the surface of the carrier core include dissolving or suspending a resin in a solvent to prepare a coating solution and coating the coating solution thereon; and simply mixing a resin and the carrier core in the state of powders.

The resin-coated carrier preferably includes a resin coating material in an amount of from 0.01 to 5% by weight, and more preferably from 0.1 to 1% by weight.

Specific examples of use, wherein a magnetic material is coated with a coating mixture including two or more materials, include carriers formed of (1) 12 parts of a mixture of dimethylchlorosilane and dimethylsilicone oil (5/1) and 100 parts of a fine powder of titanium oxide; and (2) 20 parts of a mixture of dimethylchlorosilane and dimethylsilicone oil (5/1) and 100 parts of a fine powder of silica.

As the resin coating material, a styrene-methylmethacrylate copolymer, mixtures of fluorine-containing resins and styrene copolymers or a silicone resin is preferably used. Particularly, the silicone resin is more preferably used.

Specific examples of the mixtures of fluorine-containing resins and styrene copolymers include a mixture of polyvinylidene fluoride and a styrene-methylmethacrylate copolymer; and a mixture of a polytetrafluoroethylene and a styrene-methylmethacrylate copolymer; a mixture of vinylidene fluoride-tetrafluoroethylene copolymer (10/90 to 90/10), a styrene-acrylate2-ethylhexyl copolymer (10/90 to 90/10) and a styrene-acrylate2-ethylhexyl-methylmethacrylate copolymer (20 to 60/5 to 30/10/50).

Specific examples of the silicone resin include a nitrogen-containing silicone resin and a modified silicone resin formed from a reaction between a nitrogen-containing silane coupling agent and a silicone resin.

Magnetic materials for the carrier core include iron oxides such as ferrite, iron-excess ferrite, magnetite and γ-iron oxide; an metals such as iron, cobalt, nickel and their metal alloys.

Specific examples of elements included therein include iron, cobalt, nickel, aluminum, copper, lead, magnesium, tin, zinc, antimony, beryllium, bismuth, calcium, manganese, selenium, titanium, tungsten, vanadium, etc. Copper-zinc-iron ferrite mainly including copper, zinc and iron; and manganese-magnesium-iron ferrite mainly including manganese, magnesium and iron are preferably used.

The carrier preferably has a resistivity of from $10^6$ to $10^{10}$ Ω·cm by controlling the concavities and convexities on the surface thereof an amount of a resin coated thereon.

The carrier preferably has a particle diameter of from 4 to 200 μm, more preferably from 10 to 150 μm, and much more preferably from 20 to 100 μm.

Particularly, the resin-coated carrier preferably has a 50% particle diameter of from 20 to 70 μm.

The two-component developer preferably includes the toner of the present invention in an amount of from 1 to 200 parts by weight, and more preferably from 2 to 50 parts by weight per 100 parts by weight of the carrier.

The toner container of the present invention contains the toner of the present invention or the developer.

The container is not particularly limited, and is preferably selected from known containers such as a container having a cap. The container may have a size, a shape, a structure, a material, etc. in accordance with the purpose. The container preferably has a cylindrical shape and spiral concavities and convexities on the inner circumferential face, and a part or all of which are accordion.

The container is not particularly limited, and preferably formed of a material having good size preciseness, such as a polyester resin, polyethylene, polypropylene, polystyrene, polyvinylchloride, polyacrylate, a polycarbonate resin, an ABS resin and polyacetal resin.

The developer container of the present invention is easy to store, transport and handle, and detachable from a process cartridge and an image forming apparatus to feed a developer thereto.

The process cartridge of the present invention includes at least an image bearer bearing an electrostatic latent image and an image developer developing the electrostatic latent image borne by the image bearer with a developer to form a visual image, and further includes other means optionally, such as a charger, a transferer, a cleaner, a discharger. The image developer includes at least a developer container containing the developer of the present invention and a developer bearer bearing and transferring the developer contained in the developer container, and optionally includes a layer regulator regulating a toner layer borne on the surface of the developer bearer.

Figure 22:
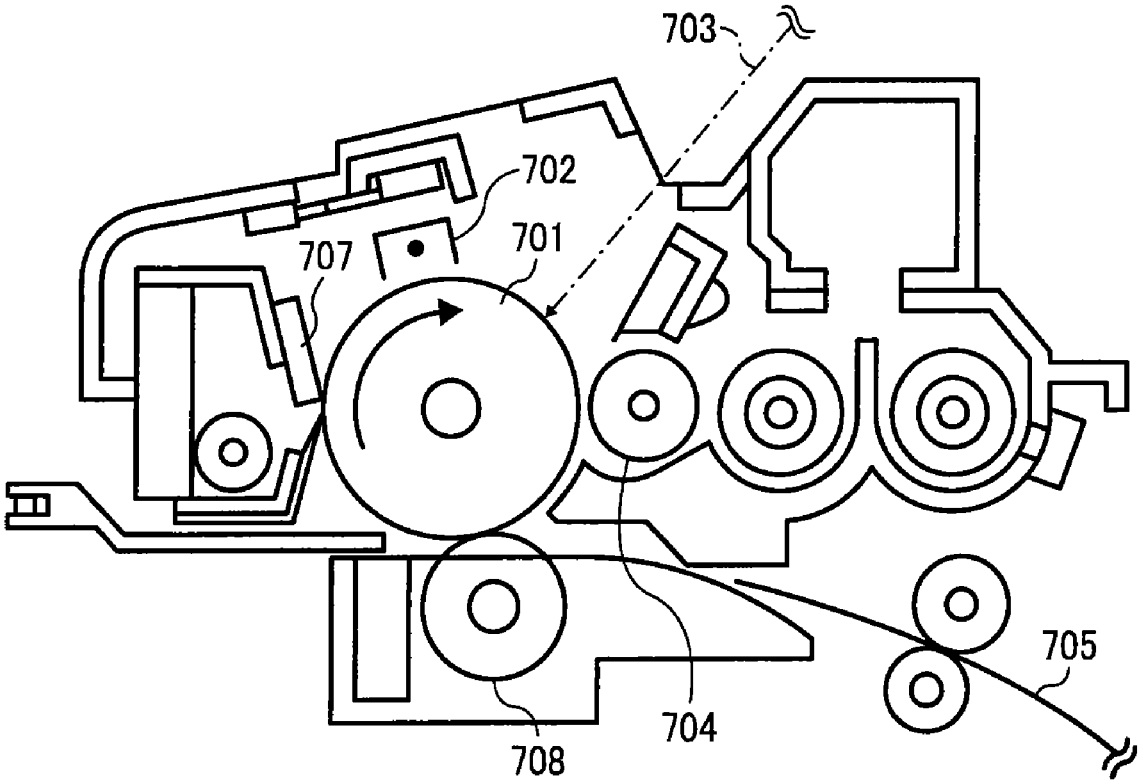
FIG. 22 is a schematic view illustrating an embodiment of the process cartridge of the present invention.

The process cartridge includes, as shown in FIG. 22, a photoreceptor 701 as an electrostatic latent image bearer and at least one of a charger 702, an image developer 704, a transferer 708, a cleaner 707 and optional other means. In FIG. 22, a numeral 703 is an irradiation from an irradiator and a numeral 705 is a recording medium.

In FIG. 22, the photoreceptor 701 is charged by the charger 702 and irradiated by the irradiation 703 of the irradiator (not shown) to form an electrostatic latent image equivalent to an irradiated image while rotated in the direction of an arrow. The electrostatic latent image is developed by the image developer 704 and the resultant visual image is transferred by the transferer 708 onto the recording medium 705, and which is printed out. Next, the surface of photoreceptor 701 is cleaned by the cleaner 707 and discharged by a discharger (not shown), and the above-mentioned operations are repeated.

An image forming method of the present invention includes at least an electrostatic latent image forming process forming an electrostatic latent image on an electrostatic latent image bearer, a development process developing the electrostatic latent image with the toner or the developer of the present invention to form a visual image, a transfer process transferring the visual image onto a recording medium and a fixing process fixing the visual image thereon upon application of heat and pressure with a fixing member; and optionally includes other processes such as a discharge process, a cleaning process, a recycle process and a control process.

An image forming apparatus of the present invention includes at least an electrostatic latent image bearer, an electrostatic latent image former forming an electrostatic latent image on the electrostatic latent image bearer, an image developer developing the electrostatic latent image with the toner or the developer of the present invention to form a visual image, a transferer transferring the visual image onto a recording medium and a fixer fixing the visual image thereon upon application of heat and pressure with a fixing member; and optionally includes other means such as a discharger, a cleaner, a recycler and a controller.

The electrostatic latent image forming process is a process of forming an electrostatic latent image on an electrostatic latent image bearer.

The material, shape, structure, size, etc. of the electrostatic latent image bearer (a photoreceptor) are not particularly limited, and can be selected from known electrostatic latent image bearers. However, the electrostatic latent image bearer preferably has the shape of a drum, and the material is preferably an inorganic material such as amorphous silicon and serene.

The electrostatic latent image is formed by uniformly charging the surface of the electrostatic latent image bearer and irradiating imagewise light onto the surface thereof with the electrostatic latent image former.

The electrostatic latent image former includes at least a charger uniformly charging the surface of the electrostatic latent image bearer and an irradiator irradiating imagewise light onto the surface thereof.

The surface of the electrostatic latent image bearer is charged with the charger upon application of voltage.

The charger is not particularly limited, and can be selected in accordance with the purpose, such as an electroconductive or semiconductive rollers, bushes, films, known contact chargers with a rubber blade, and non-contact chargers using a corona discharge such as corotron and scorotron.

The surface of the electrostatic latent image bearer is irradiated with the imagewise light by the irradiator.

The irradiator is not particularly limited, and can be selected in accordance with the purpose, provided that the irradiator can irradiate the surface of the electrostatic latent image bearer with the imagewise light, such as reprographic optical irradiators, rod lens array irradiators, laser optical irradiators and a liquid crystal shutter optical irradiators.

In the present invention, a backside irradiation method irradiating the surface of the electrostatic latent image bearer through the backside thereof may be used.

The development process is a process of forming a visual image by developing the electrostatic latent image with the toner or the developer of the present invention.

The image developer is not particularly limited, and can be selected from known image developers, provided that the image developer can develop with the toner or developer of the present invention. For example, an image developer containing the toner or developer of the present invention and being capable of feeding the toner or developer to the electrostatic latent image while contacting or not contacting thereto is preferably used, and an image developer including the above-mentioned toner container is more preferably used.

The image developer may develop a single color or multiple colors. For example, an image developer including a stirrer stirring the toner or developer to be charged and a rotatable magnet roller is preferably used.

In the image developer, the toner and the carrier are mixed and stirred, and the toner is charged and held on the surface of the rotatable magnet roller in the shape of an ear to form a magnetic brush. Since the magnet roller is located close to the electrostatic latent image bearer (photoreceptor), a part of the toner is electrically attracted to the surface thereof. Consequently, the electrostatic latent image is developed with the toner to form a visual image thereon.

The developer contained in the image developer including the toner of the present invention may be a one-component developer or a two-component developer, and either of which includes the toner of the present invention.

The transfer process is a process of transferring the visual image onto a recording medium, and it is preferable that the visual image is firstly transferred onto an intermediate transferer and secondly transferred onto a recording medium thereby. It is more preferable that two or more visual color images are firstly and sequentially transferred onto the intermediate transferer and the resultant complex full-color image is transferred onto the recording medium thereby.

The visual image is transferred by the transferer using a transfer charger charging the electrostatic latent image bearer (photoreceptor). The transferer preferably includes a first transferer transferring the two or more visual color images onto the intermediate transferer and a second transferer transferring the resultant complex full-color image onto the recording medium.

The intermediate transferer is not particularly limited, and can be selected from known transferers in accordance with the purpose, such as a transfer belt.

Each of the first and second transferers is preferably at least a transferer chargeable to separate the visual image from the electrostatic latent image bearer (photoreceptor) toward the recoding medium. The transferer may be one, or two or more.

The transferer includes a corona transferer using a corona discharge, a transfer belt, a transfer roller, a pressure transfer roller, an adhesive roller, etc.

The recording medium is not particularly limited, and can be selected from known recording media (paper).

The visual image transferred onto the recording medium is fixed thereon by a fixer. Each color toner image or the resultant complex full-color image may be fixed thereon.

The fixer is not particularly limited, can be selected in accordance with the purpose, and known heating and pressurizing means are preferably used. The heating and pressurizing means include a combination of a heating roller and a pressure roller, and a combination of a heating roller, a pressure roller and an endless belt, etc.

The heating temperature is preferably from 120 to 200° C.

In the present invention, a known optical fixer may be used with or instead of the fixer in accordance with the purpose.

The electrostatic latent image bearer is discharged by the discharger upon application of discharge bias.

The discharger is not particularly limited, and can be selected from known dischargers, provide that the discharger can apply the discharge bias to the electrostatic latent image bearer, such as a discharge lamp.

The toner remaining on the electrostatic latent image bearer is preferably removed by the cleaner.

The cleaner is not particularly limited, and can be selected from known cleaners, provide that the cleaner can remove the toner remaining thereon, such as a magnetic brush cleaner, an electrostatic brush cleaner, a magnetic roller cleaner, a blade cleaner, a brush cleaner and a web cleaner.

The toner removed by the cleaner is recycled into the image developer with a recycler.

The recycler is not particularly limited, and known transporters can be used.

Figure 23:
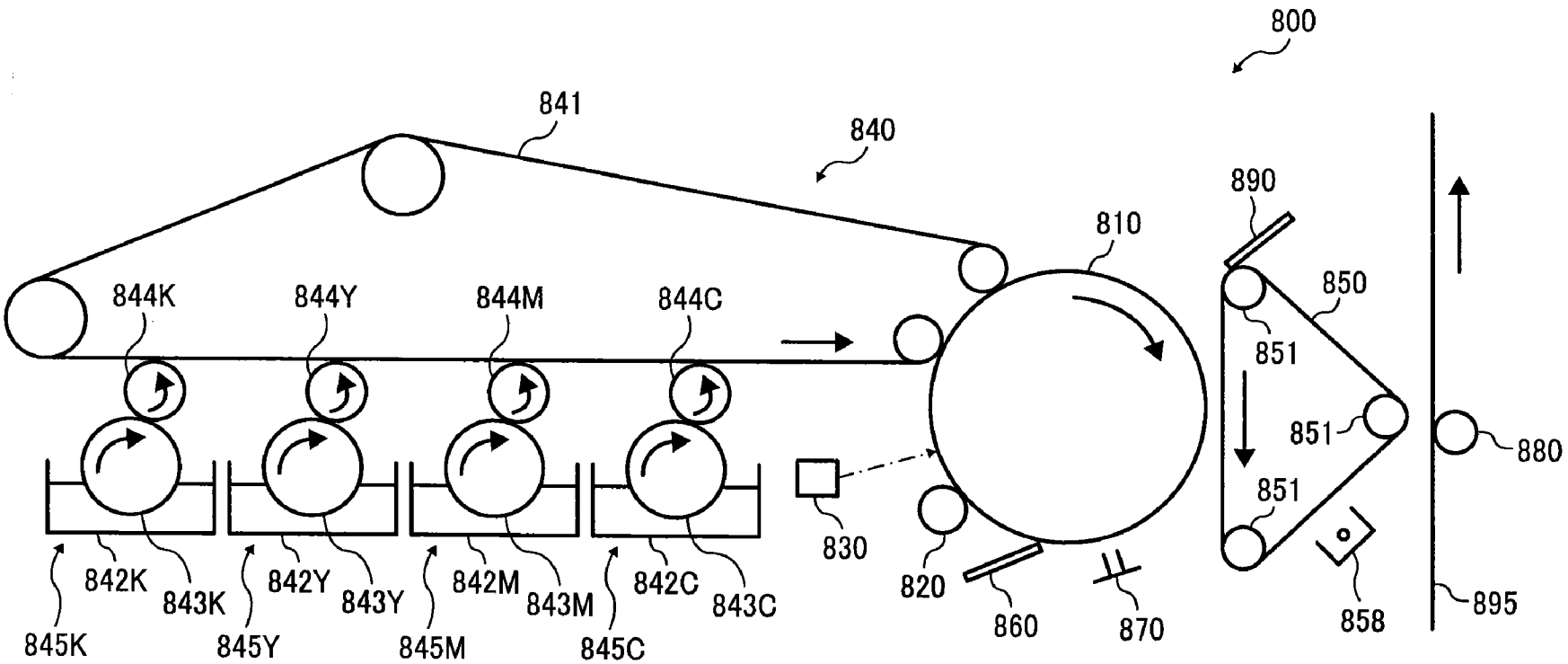
FIG. 23 is a schematic view illustrating an embodiment of the image forming apparatus of the present invention.

FIG. 23 is a schematic view illustrating an embodiment of the image forming apparatus of the present invention. An image forming apparatus 800 therein includes a photoreceptor drum 810 (hereinafter referred to as a photoreceptor 810) as an electrostatic latent image bearer, a charging roller as a charger 820, an irradiator 830, an image developer 840, an intermediate transferer 850, a cleaner 860 having a cleaning blade and a discharge lamp 870 as a discharger.

The intermediate transferer 850 is an endless belt suspended and extended by here rollers 851, and is transportable in the direction indicated by an arrow. The three rollers 851 partly work as a transfer bias roller capable of applying a predetermined first transfer bias to the intermediate transferer 850. A cleaner 890 having a cleaning blade is located close thereto and a transfer roller 880 capable of applying a transfer bias to a transfer paper 895 as a final transfer material to transfer (second transfer) the toner image thereon is located at the other side of the transfer paper 895. Around the intermediate transferer 850, a corona charger 858 charging the toner image thereon is located between a contact point of the photoreceptor 10 and the intermediate transferer 850 and a contact point of the intermediate transferer 850 and a transfer paper 895 in the rotating direction of the intermediate transferer 850.

The image developer 840 includes a developing belt 841 as a developer bearer, a black developing unit 845K, a yellow developing unit 845Y, a magenta developing unit 845M and a cyan developing unit 845C around the developing belt 841. The black developing unit 845K includes a developer container 842K, a developer feed roller 843K and a developing roller 844K; the yellow developing unit 845Y includes a developer container 842Y, a developer feed roller 843Y and a developing roller 844Y; the magenta developing unit 845M includes a developer container 842M, a developer feed roller 843M and a developing roller 844M; and the cyan developing unit 845C includes a developer container 842C, a developer feed roller 843C and a developing roller 844C. The developing belt 841 is an endless belt rotatably suspended and extended by plural rollers, and partly contacts the photoreceptor 810.

The charging roller 820 uniformly charges the photoreceptor 10. The irradiator 830 irradiates imagewise light to the photoreceptor 810 to form an electrostatic latent image thereon. The electrostatic latent image formed thereon is developed with a toner fed from the image developer 840 to form a visual image (toner image) thereon. The visual image (toner image) is transferred (first transfer) onto the intermediate transferer 850 with a voltage applied from the roller 851, and is further transferred (second transfer) onto a transfer paper 895. The toner remaining on the photoreceptor 810 is removed by a cleaner 860, and the photoreceptor 810 is discharged by the discharge lamp 870.

Figure 24:
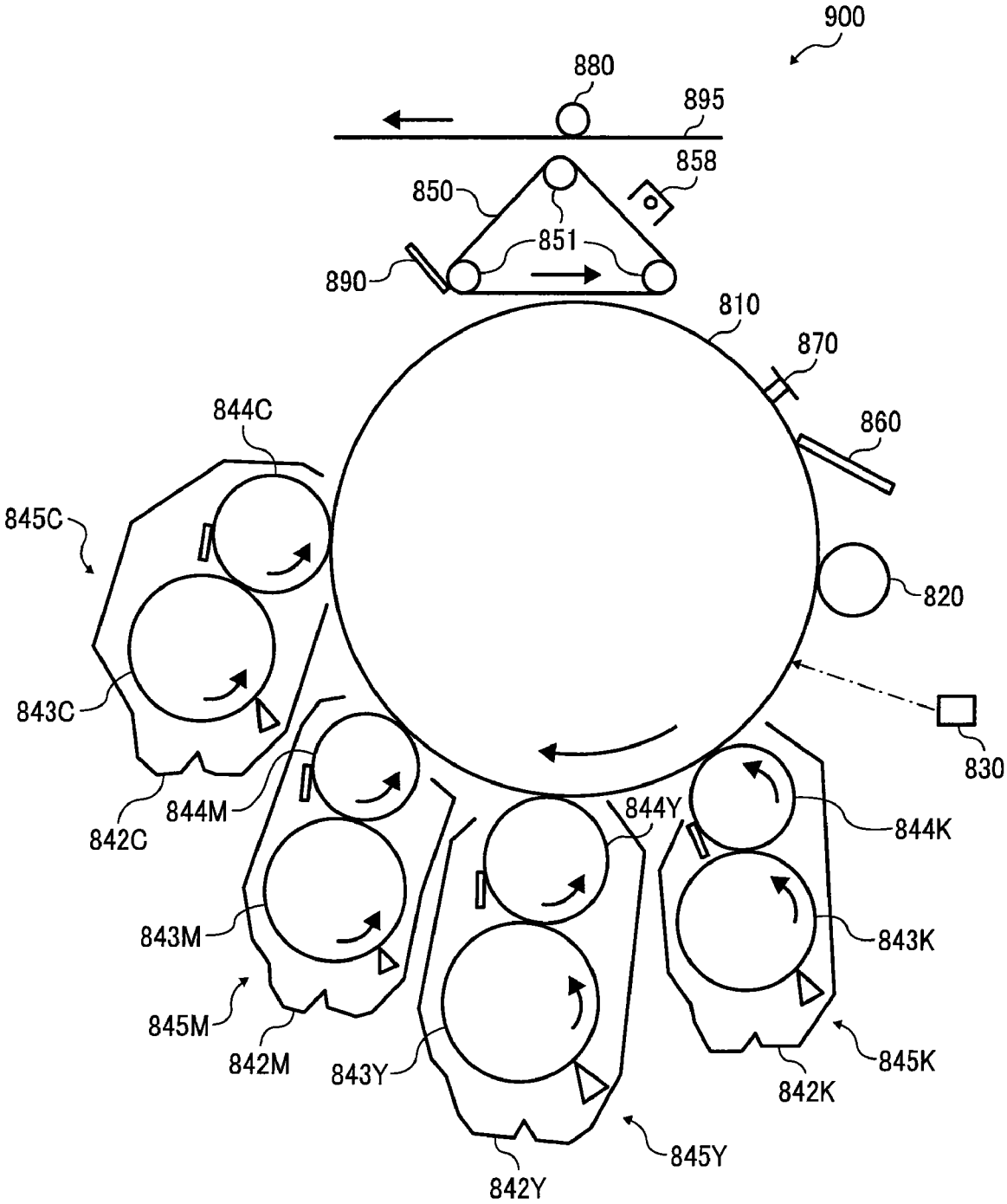
FIG. 24 is a schematic view illustrating another embodiment of the image forming apparatus of the present invention.

FIG. 24 is a schematic view illustrating another embodiment of the image forming apparatus of the present invention. An image forming apparatus 900 therein has the same constitutions as that of FIG. 23 except that the developing belt 841 is not located and the black developing unit 845K, yellow developing unit 845Y, magenta developing unit 845M and cyan developing unit 45C are located around the photoreceptor 810, facing thereto. The same elements therein have the same numbers as those in FIG. 23.

Figure 25:
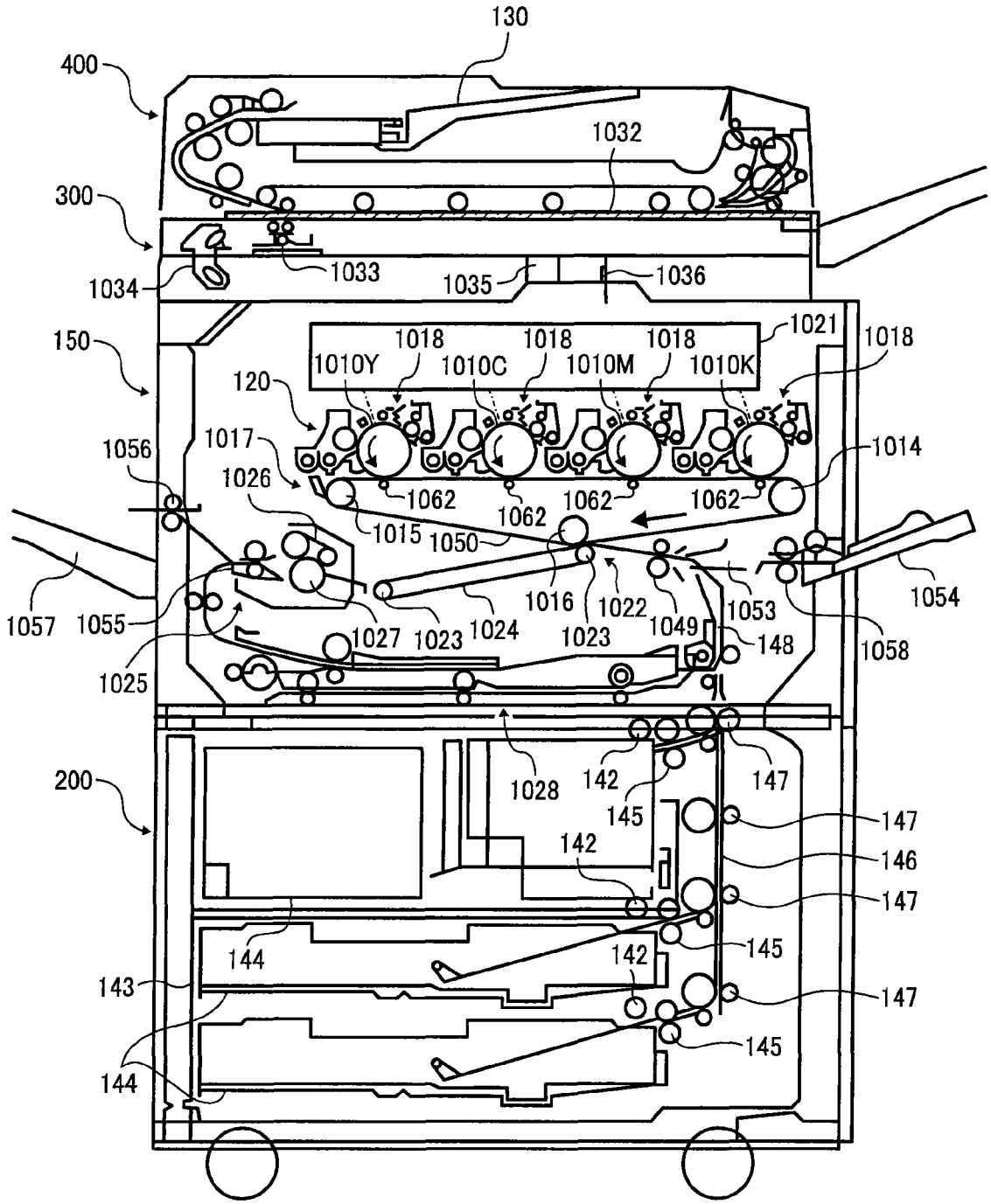
FIG. 25 is a schematic view illustrating an embodiment of the tandem image forming apparatus of the present invention.

FIG. 25 is a schematic view illustrating an embodiment of the tandem image forming apparatus of the present invention. The tandem image forming apparatus includes a duplicator 150, a paper feeding table 200, a scanner 300 and an automatic document feeder (ADF) 400.

The duplicator 150 includes an intermediate transferer 1050 having the shape of an endless belt. The intermediate transferer 1050 is suspended by three suspension rollers 1014, 1015 and 1016 and rotatable in a clockwise direction. On the left of the suspension roller 1015, an intermediate transferer cleaner 1017 is located to remove a residual toner on an intermediate transferer 1050 after an image is transferred. Above the intermediate transferer 1050, four image forming units 1018 for yellow, cyan, magenta and black colors are located in line from left to right along a transport direction of the intermediate transferer 1050 to form a tandem image forming developer 120. Above the tandem color image developer 120, an irradiator 1021 is located. On the opposite side of the tandem color image developer 120 across the intermediate transferer 1050, a second transferer 1022 is located. The second transferer 1022 includes a an endless second transfer belt 1024 and two rollers 1023 suspending the endless second transfer belt 1024, and is pressed against the suspension roller 1016 across the intermediate transferer 1050 and transfers an image thereon onto a sheet. Beside the second transferer 1022, a fixer 1025 fixing a transferred image on the sheet is located. The fixer 1025 includes an endless fixing belt 1026 and a pressure roller 1027 pressing the fixing belt 1026.

Below the second transferer 1022 and the fixer 1025, a sheet reverser 1028 reversing the sheet to form an image on both sides thereof is located in the tandem color image forming apparatus.

Next, full-color image formation using a tandem image developer 120 will be explained. An original is set on a table 130 of the ADF 400 to make a copy, or on a contact glass 1032 of the scanner 300 and pressed with the ADF 400.

When a start switch (not shown) is put on, a first scanner 1033 and a second scanner 1034 scans the original after the original set on the table 130 of the ADF 400 is fed onto the contact glass 1032 of the scanner 300, or immediately when the original set thereon. The first scanner 1033 emits light to the original and reflects reflected light there from to the second scanner 1034. The second scanner further reflects the reflected light to a reading sensor 1036 through an imaging lens 1035 to read the color original (color image) as image information of black, yellow, magenta and cyan.

Figure 26:
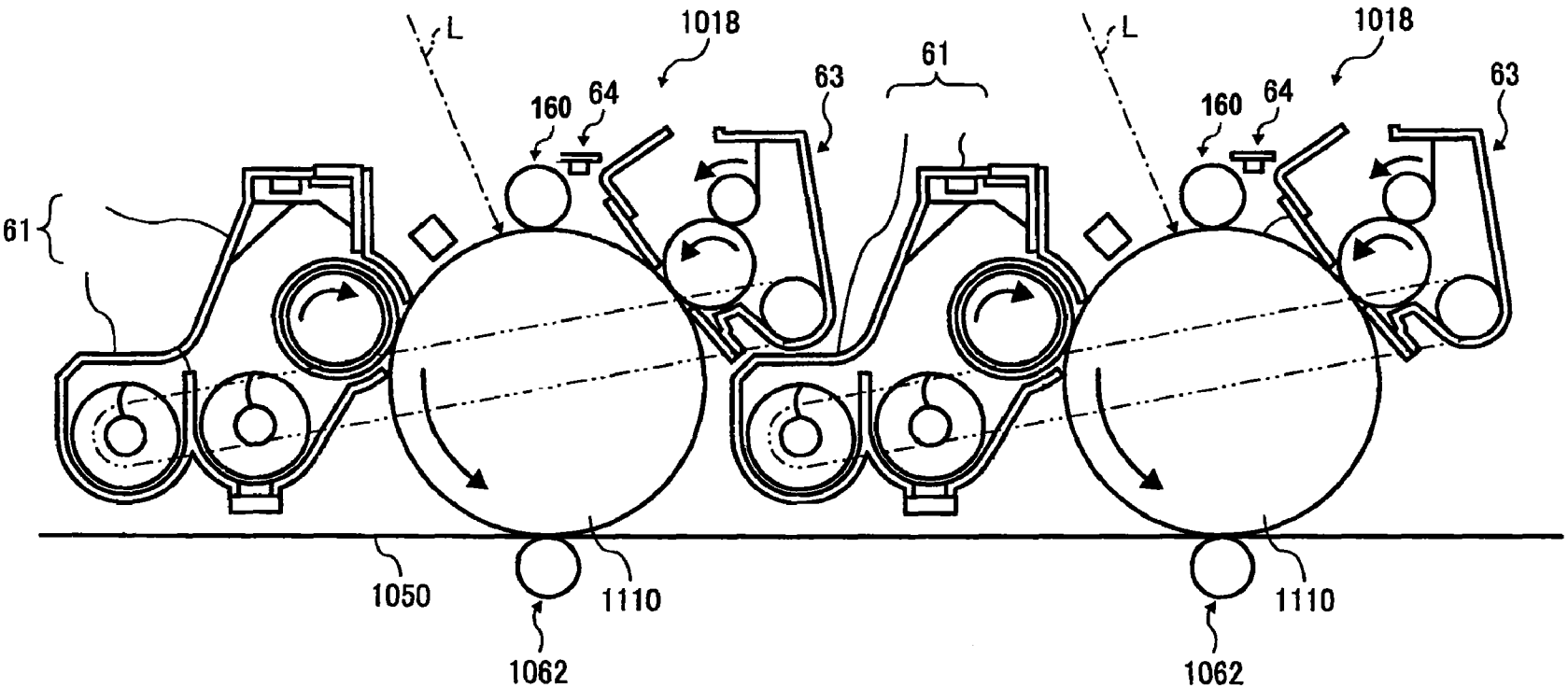
FIG. 26 is a schematic view illustrating image forming units of the tandem image forming apparatus in FIG. 25.

The black, yellow, magenta and cyan image information are transmitted to each image forming units 1018, i.e., a black image forming unit, a yellow image forming unit, a magenta image forming unit and a cyan image forming unit in the tandem image developer 120 respectively, and the respective image forming units form a black toner image, a yellow toner image, a magenta toner image and a cyan toner image. Namely, each of the image forming units 1018 in the tandem image developer 120 includes, as shown in FIG. 26, a photoreceptor 1110, i.e., a photoreceptor for black 1010K, a photoreceptor for yellow 1010Y, a photoreceptor for magenta 1010M and a photoreceptor for cyan 1010C; a charger 160 uniformly charging the photoreceptor; an irradiator irradiating the photoreceptor with imagewise light (L in FIG. 26) based on each color image information to form an electrostatic latent image thereon; an image developer 61 developing the electrostatic latent image with each color toner, i.e., a black toner, a yellow toner, a magenta toner and a cyan toner to form a toner image thereon; a transfer charger 1062 transferring the toner image onto an intermediate transferer 1050; a photoreceptor cleaner 63; and a discharger 64. When a start switch (not shown) is put on, a drive motor (not shown) rotates one of the suspension rollers 1014, 1015 and 1016 such that the other two rollers are driven to rotate, to rotate the intermediate transferer 1050. At the same time, each of the image forming units 1018 rotates the photoreceptor 1110 and forms a single-colored image, i.e., a black image (K), a yellow image (Y), a magenta image (M) and cyan image (C) on each photoreceptor 1010K, 1010Y, 1010M and 1010C. The single-colored images are sequentially transferred (first transfer) onto the intermediate transferer 1050 to form a full-color image thereon.

On the other hand, when start switch (not shown) is put on, one of paper feeding rollers 142 of paper feeding table 200 is selectively rotated to take a sheet out of one of multiple-stage paper cassettes 144 in a paper bank 143. A separation roller 145 separates sheets one by one and feed the sheet into a paper feeding route 146, and a feeding roller 147 feeds the sheet into a paper feeding route 148 to be stopped against a registration roller 1049. Alternatively, a paper feeding roller 142 is rotated to take a sheet out of a manual feeding tray 1054, and a separation roller 1058 separates sheets one by one and feed the sheet into a paper feeding route 1053 to be stopped against the registration roller 1049. The registration roller 1049 is typically earthed, and may be biased to remove a paper dust from the sheet. Then, in timing with a synthesized full-color image on the intermediate transferer 1050, the registration roller 1049 is rotated to feed the sheet between the intermediate transferer 1050 and the second transferer 1022, and the second transferer transfers (second transfer) the full-color image onto the sheet. The intermediate transferer 1050 after transferring an image is cleaned by the intermediate transferer cleaner 1017 to remove a residual toner there on after the image is transferred.

The sheet the full-color image is transferred on is fed by the second transferer 1022 to the fixer 1025. The fixer 1025 fixes the image thereon upon application of heat and pressure, and the sheet is discharged by a discharge roller 1056 onto a catch tray 1057 through a switch-over click 1055. Alternatively, the switch-over click 1055 feeds the sheet into the sheet reverser 28 reversing the sheet to a transfer position again to form an image on the back side of the sheet, and then the sheet is discharged by the discharge roller 1056 onto the catch tray 1057.

The image forming method and the image forming apparatus of the present invention can produce high-quality images because of using the toner of the present invention, having a sharp particle diameter distribution and good properties such as chargeability, environmental resistance and temporal stability.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

[Evaluation Methods]

<Sprayability>

A voltage of 10 V, 20 V and 30 V were applied to the piezoelectric body.

◎: good sprayability at 10 V

○: good sprayability at 20 V

Δ: good sprayability at 30 V x: poor sprayability at 30 V xx: not sprayable even at 30 V The results are shown in Table 1.

The piezoelectric body generated heat at 30 V and it was difficult to operate continuously.

<Particle Diameter Distribution>

The weight-average particle diameter (D4) and the number-average particle diameter (Dn) were measured by Multisizer III from Beckman Coulter, Inc. using an aperture of 100 μm. An analysis software Beckman Multisizer 3 Version 3.51 was used. Specifically, 0.5 g of the toner and 0.5 ml of a surfactant (alkylbenzenesulfonate Neogen SC-A from Daiichi Kogyo Seiyaku Co., Ltd.) having a concentration of 10% by weight were mixed with a micro spatel in a glass beaker having a capacity of 100 ml, and 80 ml of ion-exchange water was added to the mixture. The mixture was dispersed by an ultrasonic disperser W-113MK-II from HONDA ELECTRONICS CO., LTD. for 10 min. The dispersion was measure by Multisizer III using ISOTON III as a measurement solution from Beckman Coulter, Inc. The dispersion was dropped such that Multisizer III displays a concentration of 8±2%, which is essential in terms of measurement reproducibility of the particle diameter. The particle diameter has no accidental error in the range of the concentration. Thirteen channels of 2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm were used. After the volume and number of a toner are measured, the volume distribution and number distribution are determined. The weight-average particle diameter (D4) and the number-average particle diameter (Dn) can be determined from the distributions. As an index of the particle diameter distribution, D4/Dn is used. When a toner is completely mono-dispersed, D4/Dn is 1. The larger D4/Dn, the wider the distribution.

<Molecular Weight Distribution Mw/Mn>

The molecular weight distribution of THF-soluble components of the binder resin is measured by a GPC measurer GPC-150C from Waters Corp. A column (KF801 to 807 from Shodex) is stabilized in a heat chamber having a temperature of 40° C.; THF is put into the column at a speed of 1 ml/min as a solvent; 0.05 g of the binder resin is fully dissolved in 5 g of THF and the solution is filtered through a filter such as CHROMATODISC having a pore diameter of 0.45 μm from Kurabo Industries, Ltd.; and, finally 50 to 200 μl of a THF liquid-solution of a resin, having a sample concentration of from 0.05 to 0.6% by weight, is put into the column to measure. A molecular weight distribution of the sample is determined by using a calibration curve which is previously prepared using several polystyrene standard samples having a single distribution peak, and which shows the relationship between a count number and the molecular weight. As the standard polystyrene samples for making the calibration curve, for example, the samples having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $48\times10^6$ from Pressure Chemical Co. or Tosoh Corporation are used. It is preferable to use at least 10 standard polystyrene samples. In addition, an RI (refraction index) detector is used as the detector.

<Ethylacetate-Insoluble Component>

90 g of ethylacetate is added to 10 g of the binder resin, and the mixture was stirred with a stirring bar at 20° C. for 60 min and left for 20 to 30 hrs at 20° C. Ethylacetate-insoluble components settled out is separated off with a filter paper FILTRT PAPER No. 7 from Advantech Co., Ltd. The insoluble components separated on the filter paper are subjected to a suction filtration while washed with ethylacetate. The separated insoluble components are heated at 120° C. for 3 hrs to volatilize the ethylacetate, and a weight thereof is measured.

<Tm (½ Flow Temperature)>

In the present invention, Tm is measured by an elevated flow tester CFT-500C from Shimadzu Corp. at a load of 10 Kg, a die aperture of 0.5 mm and a rate of temperature increase of 3° C. Tm is a temperature at which a half of the sample has flowed.

<Tg (Glass Transition Temperature)>

The glass transition temperature (Tg) is measured by TG-DSC system TAS-100 from RIGAKU Corp. at a programming rate of 10° C./min.

First, about 10 mg of a sample in an aluminum container was loaded on a holder unit, which was set in an electric oven. After the sample was heated in the oven at from a room temperature to 150° C. and a programming speed of 10° C./min, the sample was left for 10 min at 150° C. After the samples was cooled to have a room temperature and left for 10 min, the sample was heated again in a nitrogen environment to have a temperature of 150° C. at a programming speed of 10° C./min and DSC measurement of the sample was performed. Tg was determined from a contact point between a tangent of a heat absorption curve close to Tg and base line using an analyzer in TAS-100.

<Hot Offset Resistance>

A toner having a low Tm cannot be used for oilless fixation. Toners which are not fixable by oilless fixation were fixed by oil application fixation and evaluated.

(1) Oil Application Fixation

A developer was set in a copier imagio Color C385 from Ricoh Company, Ltd. and images were produced thereby on TYPE 6000 papers from Ricoh Company, Ltd. while changing the fixing temperature from low to high temperatures. A temperature at which image glossiness lowered or a temperature at which an offset image was produced was determined as an offset occurrence temperature. 200° C. or higher was ○ and lower than 200° C. was x. The results are shown in Table 1.

(2) Oilless Fixation

A developer was set in a copier imagio Neo 455 from Ricoh Company, Ltd. and images were produced thereby on TYPE 6000 papers from Ricoh Company, Ltd. while changing the fixing temperature from low to high temperatures. A temperature at which image glossiness lowered or a temperature at which an offset image was produced was determined as an offset occurrence temperature. 200° C. or higher was ○ and lower than 200° C. was x. The results are shown in Table 1.

Example 1

(Preparation of Colorant Dispersion)

First, a carbon black dispersion was prepared.

20 parts of carbon black (Regal 1400 from Cabot Corp.), 2 parts of a pigment dispersant (AJISPER PB821 from Ajinomoto Fine-Techno Co., Inc.) and 78 parts of ethylacetate were primarily dispersed by a mixer having a stirring blade to prepare a primary dispersion. The primary dispersion was further dispersed with higher shearing strength by a dynomill to prepare a secondary dispersion completely free from aggregates. Further, the secondary dispersion was passed through a filter made of PTFE having a pore size of 0.45 μm to prepare a sub-micron colorant dispersion.

(Preparation of Resin and Wax Dispersion)

168 parts of a polyester resin as a binder resin having a Mw of 7,000, a ratio Mw/Mn of 1.5, a Mp of 6,000, no component having a Mw not less than 100,000, no ethylacetate-insoluble component, a Tg of 59° C. and a Tm of 114° C.; 10 parts of carnauba wax; and 1,722 parts of ethylacetate were placed in a container having a stirring blade and a thermometer. The mixture was heated to have a temperature of 85° C. and stirred for 20 min to dissolve the polyester resin and the carnauba wax in the ethylacetate. The solution was quickly cooled to separate the particulate carnauba wax. The dispersion was further dispersed with higher shearing strength by a dynomill to prepare a resin and wax dispersion.

(Preparation of Toner Constituent Liquid)

50 parts of the carbon black dispersion and 950 parts of the resin and wax dispersion were mixed by a mixer having a stirring blade to prepare a toner constituent liquid.

The resultant toner constituent liquid was further diluted with ethylacetate to have a solid content of 10.0% by weight.

(Preparation of Toner)

The toner constituent liquid was fed to the nozzle 1 of the toner preparation apparatus 1. The nozzle plate is formed of a nickel plate having an outer diameter of 8.0 mm and a thickness of 20 μm, on which perfectly-circular discharge apertures having a diameter of 10 μm were formed by electroforming. The discharge apertures formed in the shape of a houndstooth check at the center of the plate in an area having a diameter of 5 mm such that there is a distance of 100 μm between each discharge aperture. In this case, 1,000 effective discharge apertures were formed.

After a droplet was discharged under the following conditions, the droplet was dried and solidified to prepare toner particles.

Dry airflow rate: Nitrogen gas for dispersion 2.0 L/min

Drying nitrogen gas in apparatus 30.0 L/min

Temperature in apparatus: 38 to 40° C.

Nozzle oscillation frequency: 180 kHz

Voltage applied to piezoelectric body: 10 V

The dried and solidified toner particles were collected with a filter with pores having a diameter of 1 μm. Further, 1.0% by weight of a hydrophobic silica H2000 from Clariant (Japan) K.K. was externally added to the toner particles by HENSCHEL MIXER from Mitsui Mining Co., ltd. Then, toner particles was subjected to de-solvent for 48 hrs by an air dryer to prepare a black toner a.

The sprayability of the toner constituent liquid was good, and the nozzle was not blocked even spayed for 2 hrs.

The toner had a D4 of 6.2 μm and a D4/Dn of 1.06 as shown in Table 1, therefor the toner had a very sharp particle diameter distribution.

The toner had a Tm of 115° C.

(Preparation of Carrier)

The following materials were mixed and dispersed by a homomixer for 20 min to prepare a coating liquid. The coating liquid was coated by a fluidized-bed coater on 1,000 parts of spherical magnetite having a particle diameter of 50 μm to prepare a magnetic carrier A.

| | |
|---|---|
| Silicone resin (organo straight silicone) | 100 |
| Toluene | 100 |
| γ-(2-aminoethyl)aminopropyltrimethoxysilane | 5 |
| Carbon black | 10 |

(Preparation of Developer)

4 parts of the black toner a and 96 parts of the magnetic carrier A were mixed by a ball mill to prepare a two-component developer 1. The developer was set in a copier imagio Color C385 from Ricoh Company, Ltd. using oil application fixation. The hot offset resistance of the developer was evaluated, which was good as shown in Table 1.

Example 2

The procedures for preparation and evaluation of the toner and the developer in Example 1 were repeated except for changing the binder resin in the resin and wax dispersion to a polyester resin having a Mw of 32,000, a ratio Mw/Mn of 6.5, a Mp of 2,000, 14.2% by weight of components having a Mw not less than 100,000, no ethylacetate-insoluble component, a Tg of 60° C. and a Tm of 133° C., and the oil application fixation to the oilless fixation. The results are shown in Table 1.

The sprayability of the toner constituent liquid was good, and the nozzle was not blocked even spayed for 2 hrs.

The toner had a D4 of 6.0 μm and a D4/Dn of 1.05 as shown in Table 1, therefor the toner had a very sharp particle diameter distribution.

The toner had a Tm of 134° C., and the hot offset resistance of the developer was good.

Example 3

The procedures for preparation and evaluation of the toner and the developer in Example 2 were repeated except for changing the binder resin in the resin and wax dispersion to a polyester resin having a Mw of 68,000, a ratio Mw/Mn of 15.0, a Mp of 2,000, 14.2% by weight of components having a Mw not less than 100,000, no ethylacetate-insoluble component, a Tg of 61° C. and a Tm of 149° C. The results are shown in Table 1.

The sprayability of the toner constituent liquid was good, and the nozzle was not blocked even spayed for 2 hrs.

The toner had a D4 of 5.9 μm and a D4/Dn of 1.05 as shown in Table 1, therefor the toner had a very sharp particle diameter distribution.

The toner had a Tm of 150° C., and the hot offset resistance of the developer was good.

Example 4

The procedures for preparation and evaluation of the toner and the developer in Example 2 were repeated except for changing the binder resin in the resin and wax dispersion to a styrene-butylacrylate copolymer resin having a Mw of 52,000, a ratio Mw/Mn of 4.8, a Mp of 49,000, 12.1% by weight of components having a Mw not less than 100,000, no ethylacetate-insoluble component, a Tg of 61° C. and a Tm of 131° C. The results are shown in Table 1.

The sprayability of the toner constituent liquid was good, and the nozzle was not blocked even spayed for 2 hrs.

The toner had a D4 of 5.9 μm and a D4/Dn of 1.03 as shown in Table 1, therefor the toner had a very sharp particle diameter distribution.

The toner had a Tm of 132° C., and the hot offset resistance of the developer was good.

Example 5

The procedures for preparation and evaluation of the toner and the developer in Example 2 were repeated except for changing the binder resin in the resin and wax dispersion to 100.8 parts of a polyester resin having a Mw of 32,000, a ratio Mw/Mn of 6.5, a Mp of 16,000, 5.2% by weight of components having a Mw not less than 100,000, no ethylacetate-insoluble component, a Tg of 60° C. and a Tm of 133° C. and 67.2 parts of a styrene-butylacrylate copolymer resin having a Mw of 52,000, a ratio Mw/Mn of 4.8, a Mp of 49,000, 12.1% by weight of components having a Mw not less than 100,000, no ethylacetate-insoluble component, a Tg of 61° C. and a Tm of 131° C. The results are shown in Table 1.

The sprayability of the toner constituent liquid was good, and the nozzle was not blocked even spayed for 2 hrs.

The toner had a D4 of 5.9 μm and a D4/Dn of 1.04 as shown in Table 1, therefor the toner had a very sharp particle diameter distribution.

The toner had a Tm of 133° C., and the hot offset resistance of the developer was good.

Example 6

The procedures for preparation and evaluation of the toner and the developer in Example 2 were repeated except for diluting the resultant toner constituent liquid with further ethylacetate to have a solid content of 5.0% by weight and changing the diameter of the discharge apertures on the nozzle plate from 10 to 3 μm. The results are shown in Table 1.

The sprayability of the toner constituent liquid was good, and the nozzle was not blocked even spayed for 2 hrs.

The toner had a D4 of 1.7 μm and a D4/Dn of 1.03 as shown in Table 1, therefor the toner had a very sharp particle diameter distribution.

The toner had a Tm of 134° C., and the hot offset resistance of the developer was good.

Example 7

The procedures for preparation and evaluation of the toner and the developer in Example 2 were repeated except for changing 1,722 to 222 parts of ethylacetate to prepare a resin and wax dispersion, 950 to 200 parts thereof to prepare a toner constituent liquid, diluting the resultant toner constituent liquid with further ethylacetate to have a solid content of 40.0% by weight, and changing the diameter of the discharge apertures on the nozzle plate from 10 to 30 μm. The results are shown in Table 1.

The sprayability of the toner constituent liquid was slightly poor, but the nozzle was not blocked even spayed for 2 hrs.

The toner had a D4 of 14.6 μm and a D4/Dn of 1.13 as shown in Table 1, therefor the toner had slightly a broad particle diameter distribution.

The toner had a Tm of 134° C., and the hot offset resistance of the developer was good.

Example 8

The procedures for preparation and evaluation of the toner and the developer in Example 2 were repeated except for feeding the toner constituent liquid to the ring oscillator head formed of a circular oscillator (piezoelectric body) in FIG. 11 having a nozzle oscillation frequency of 98 kHz.

The sprayability of the toner constituent liquid was good, and the nozzle was not blocked even spayed for 2 hrs.

The toner had a D4 of 6.0 μm and a D4/Dn of 1.07 as shown in Table 1, therefor the toner had a very sharp particle diameter distribution.

The toner had a Tm of 134° C., and the hot offset resistance of the developer was good.

Comparative Example 1

The procedures for preparation and evaluation of the toner and the developer in Example 1 were repeated except for changing the binder resin in the resin and wax dispersion to a polyester resin having a Mw of 5,000, a ratio Mw/Mn of 1.4, a Mp of 4,500, 0.3% by weight of components having a Mw not less than 100,000, no ethylacetate-insoluble component, a Tg of 59° C. and a Tm of 109° C. The results are shown in Table 1.

The sprayability of the toner constituent liquid was good, and the nozzle was not blocked even spayed for 2 hrs.

The toner had a D4 of 6.0 μm and a D4/Dn of 1.05 as shown in Table 1, therefor the toner had a very sharp particle diameter distribution.

The toner had a Tm of 134° C., and the hot offset resistance of the developer was good.

Comparative Example 2

The procedures for preparation and evaluation of the toner and the developer in Example 2 were repeated except for changing the binder resin in the resin and wax dispersion to a polyester resin having a Mw of 81,000, a ratio Mw/Mn of 20.0, a Mp of 9,500, 16.4% by weight of components having a Mw not less than 100,000, no ethylacetate-insoluble component, a Tg of 60° C. and a Tm of 135° C. The results are shown in Table 1.

The sprayability of the toner constituent liquid was poor, and was still poor even a voltage 30 V was applied to the piezoelectric body.

The toner had a D4 of 5.8 μm and a D4/Dn of 1.09 as shown in Table 1, therefor the toner had a sharp particle diameter distribution.

The toner had a Tm of 136° C., and the hot offset resistance of the developer was good.

Comparative Example 3

The procedure for preparation of the toner constituent liquid in Example 2 was repeated except for changing the binder resin in the resin and wax dispersion to a polyester resin having a Mw of 160,00, a ratio Mw/Mn of 20.0, a Mp of 8,600, 20.1% by weight of components having a Mw not less than 100,000, no ethylacetate-insoluble component, a Tg of 60° C. and a Tm of 159° C., and diluting the resultant toner constituent liquid with further ethylacetate to have a solid content of 5.0% by weight.

The toner constituent liquid was not sprayed even a voltage 30 V was applied to the piezoelectric body.

The toner constituent liquid had a Tm of 160° C. after dried (subjected to de-solvent).

Comparative Example 4

The procedure for preparation of the toner constituent liquid in Example 2 was repeated except for changing the binder resin in the resin and wax dispersion to a polyester resin having a Mw of 110,000, a ratio Mw/Mn of 16.0, a Mp of 9,000, 27.9% by weight of components having a Mw not less than 100,000, 3.0% by weight of ethylacetate-insoluble components, a Tg of 61° C. and a Tm of 152° C., and diluting the resultant toner constituent liquid with further ethylacetate to have a solid content of 5.0% by weight.

The toner constituent liquid was not sprayed well even a voltage 30 V was applied to the piezoelectric body, and was not sprayed at all two min later.

The toner constituent liquid had a Tm of 153° C. after dried (subjected to de-solvent).

TABLE 1

| | A | B | C | D | E | F | G | H | |
|---|---|---|---|---|---|---|---|---|---|
| Example 1 | 114 | 0 | 1.5 | ◎ | 6.2 | 1.06 | 115 | w/Oil | ○ |
| Example 2 | 133 | 0 | 6.5 | ○ | 6.0 | 1.05 | 134 | Oilless | ○ |
| Example 3 | 149 | 0 | 15 | ○ | 5.9 | 1.05 | 150 | Oilless | ◎ |
| Example 4 | 131 | 0 | 4.8 | ○ | 5.9 | 1.03 | 132 | Oilless | ○ |
| Example 5 | 132 | 0 | 6.5 | ○ | 5.9 | 1.04 | 133 | Oilless | ○ |
| Example 6 | 133 | 0 | 6.5 | ○ | 1.7 | 1.03 | 134 | Oilless | ○ |
| Example 7 | 133 | 0 | 6.5 | Δ | 14.6 | 1.13 | 134 | Oilless | ○ |
| Example 8 | 133 | 0 | 6.5 | ○ | 6.0 | 1.07 | 134 | Oilless | ○ |
| Comparative Example 1 | 109 | 0 | 1.4 | ◎ | 6.3 | 1.08 | 110 | w/Oil | X |
| Comparative Example 2 | 135 | 0 | 20 | X | 5.8 | 1.09 | 136 | Oilless | ○ |
| Comparative Example 3 | 159 | 0 | 20 | XX | — | — | 16 | Oilless | — |
| Comparative Example 4 | 152 | 3 | 16 | X | — | — | 153 | Oilless | — |

A: Tm (° C.) of Resin
B: Ethylacetate-insoluble components of Resin (%)
C: Mw/Mn
D: Sprayability
E: D4 (μm)
F: D4/Dn
G: Tm (° C.) of Toner
H: Hot Offset Resistance This application claims priority and contains subject matter related to Japanese Patent Application No. 2007-288724 filed on Nov. 6, 2007, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method of preparing a toner, comprising:

periodically discharging a toner constituent liquid from plural nozzles having the same aperture diameter with a mechanical oscillator, wherein the toner constituent liquid comprises:

a binder resin, wherein the binder resin has a peak molecular weight of from 6,000 to 50,000 in a molecular weight distribution measured by GPC of THF-soluble components thereof, a colorant, and an organic solvent, wherein the colorant is dissolved or dispersed in the organic solvent, wherein the binder resin is completely dissolved in the organic solvent;

forming a droplet of the toner constituent liquid in a gas phase; and solidifying the droplet, wherein the aperture diameter is from 3 to 30 μm, and the binder resin has a ratio (Mw/Mn) of a weight-average molecular weight (Mw) to a number-average molecular weight (Mn) of THF(tetrahydrofuran)-soluble components therein of from 1.5 to 15 in a molecular weight distribution measured by GPC (gel permeation chromatography), and a ½ flow temperature (Tm) of from 114 to 149° C.

2. The method of claim 1, wherein the toner constituent liquid further comprises a wax.

3. The method of claim 1, further comprising:

oscillating a thin film formed on a reservoir reserving the toner constituent liquid, on which the plural nozzles are formed, with the mechanical oscillator to periodically discharge the toner constituent liquid from the plural nozzles, wherein the mechanical oscillator is circularly formed on the circumference of the plural nozzles.

4. The method of claim 1, further comprising:

oscillating a thin film formed on a reservoir reserving the toner constituent liquid, on which the plural nozzles are formed, with the mechanical oscillator to periodically discharge the toner constituent liquid from the plural nozzles, wherein the mechanical oscillator comprises a vertically-oscillating surface parallel to the thin film.

5. The method of claim 4, wherein the mechanical oscillator is a horn oscillator.

6. The method of claim 1, wherein the mechanical oscillator has an oscillation frequency of from 20 kHz to less than 2.0 MHz.

* * * * *